US010598114B2

(12) United States Patent
Imai

(10) Patent No.: US 10,598,114 B2
(45) **Date of Patent: *Mar. 24, 2020**

(54) FUEL INJECTION CONTROLLER AND FUEL INJECTION SYSTEM

(71) Applicant: DENSO CORPORATION, Kariya, Aichi-pref. (JP)

(72) Inventor: Keita Imai, Kariya (JP)

(73) Assignee: DENSO CORPORATION, Kariya (JP)

( * ) Notice: Subject to any disclaimer, the term of this patent is extended or adjusted under 35 U.S.C. 154(b) by 81 days.

This patent is subject to a terminal disclaimer.

(21) Appl. No.: 15/966,058

(22) Filed: Apr. 30, 2018

(65) Prior Publication Data

US 2018/0245534 A1 Aug. 30, 2018

Related U.S. Application Data

(63) Continuation of application No. 15/270,013, filed on Sep. 20, 2016, now Pat. No. 9,982,616, which is a (Continued)

(30) Foreign Application Priority Data

Feb. 25, 2013 (JP) ..... 2013-34932

(51) Int. Cl.
*F02D 41/20* (2006.01)
*F02D 41/38* (2006.01)
(Continued)

(52) U.S. Cl.
CPC ..... *F02D 41/20* (2013.01); *F02D 41/38* (2013.01); *F02D 41/402* (2013.01);
(Continued)

(58) Field of Classification Search
CPC ..... F02D 41/20; F02D 41/38; F02D 41/402; F02D 2041/2013; F02D 2041/2027;
(Continued)

(56) References Cited

U.S. PATENT DOCUMENTS 5,392,995 A * 2/1995 Wahba ..... F02M 51/0614 239/585.1
5,402,760 A 4/1995 Takeuchi et al.
(Continued)

FOREIGN PATENT DOCUMENTS

JP 7-103020 4/1995
JP 09-217641 8/1997
(Continued)

OTHER PUBLICATIONS

Office Action (4 pages) dated Mar. 24, 2015, issued in corresponding Japanese Application No. 2013-034932 and English translation (4 pages).

(Continued)

*Primary Examiner* — Phutthiwat Wongwian
*Assistant Examiner* — Susan E Scharpf
(74) *Attorney, Agent, or Firm* — Nixon & Vanderhye P.C.

(57) ABSTRACT

A fuel injection controller includes an increase control portion applying the boost voltage to the coil to increase a coil current to a first target value, and a constant current control portion applying a voltage to the coil to hold the coil current to a second target value. A threshold is an energization time period that is necessary to reach a boundary point between a seat throttle area of a property line and an injection-port throttle area of the property line from an energization start time point. An initial-current applied time period is from the energization start time point that the boost voltage starts to be applied to the coil to a time point that the coil current is decreased to the second target value. The increase control portion controls the coil current such that the initial-current applied time period is less than the threshold.

13 Claims, 15 Drawing Sheets

Related U.S. Application Data continuation of application No. 14/189,351, filed on Feb. 25, 2014, now Pat. No. 9,476,376.

(51) Int. Cl.
*F02D 41/40* (2006.01)
*F02M 51/00* (2006.01)
*F02M 51/06* (2006.01)

(52) U.S. Cl.
CPC ..... *F02M 51/005* (2013.01); *F02M 51/0621* (2013.01); *F02D 2041/2013* (2013.01); *F02D 2041/2027* (2013.01); *F02D 2041/2034* (2013.01); *F02D 2041/2065* (2013.01); *F02D 2041/389* (2013.01)

(58) Field of Classification Search
CPC ..... F02D 2041/2034; F02D 2041/2065; F02D 2041/389; F02M 51/005; F02M 51/0621
See application file for complete search history.

(56) References Cited

U.S. PATENT DOCUMENTS 5,430,601 A * 7/1995 Burcham ..... F02D 41/20 123/490
5,924,403 A 7/1999 Thomas
5,979,412 A * 11/1999 Werner ..... F02D 41/20 123/490
6,508,232 B2 * 1/2003 Sogawa ..... F02B 61/045 123/198 R
6,532,940 B1 3/2003 Ono et al.
6,571,773 B1 6/2003 Yamakado et al.
7,945,374 B2 * 5/2011 Keegan ..... F02D 41/0085 123/478
8,214,132 B2 * 7/2012 Bunni ..... F02D 41/20 123/472
8,514,541 B2 * 8/2013 Hatanaka ..... F02D 41/20 361/152
2006/0171091 A1 * 8/2006 Seale ..... F01L 9/04 361/160
2009/0177367 A1 7/2009 Toyohara et al.
2009/0183714 A1 * 7/2009 Mayuzumi ..... F02D 41/20 123/490
2010/0043758 A1 2/2010 Caley
2010/0059023 A1 * 3/2010 Schmauss ..... H03K 17/08142 123/490
2010/0250095 A1 9/2010 Yamada et al.
2011/0220067 A1 * 9/2011 Okonogi ..... F02D 41/20 123/480
2012/0216783 A1 * 8/2012 Kusakabe ..... F02D 41/20 123/490
2013/0139791 A1 * 6/2013 Kusakabe ..... F02D 41/20 123/478
2014/0076284 A1 3/2014 Gunji et al.
2014/0238354 A1 8/2014 Imai
2014/0318498 A1 * 10/2014 Rumpsa ..... F02D 41/3005 123/478
2017/0009689 A1 1/2017 Imai

FOREIGN PATENT DOCUMENTS

JP 11-82123 3/1999
JP 2002-021679 1/2002
JP 2004-207365 7/2004
JP 2006-022757 1/2006
JP 2006-233848 9/2006
JP 2008-291692 12/2008
JP 2010-043603 2/2010
JP 2010-116852 5/2010
JP 2010-203237 9/2010
JP 2010-216344 9/2010
JP 2011-32922 2/2011
JP 2013-002476 1/2013

OTHER PUBLICATIONS

U.S. Appl. No. 15/270,013, filed Sep. 20, 2016 (49 pgs.).

* cited by examiner

FUEL INJECTION CONTROLLER AND FUEL INJECTION SYSTEM

CROSS REFERENCE TO RELATED APPLICATIONS

This is a continuation of U.S. application Ser. No. 15/270,013, filed Sep. 20, 2016 which is a continuation of U.S. application Ser. No. 14/189,351, filed Feb. 25, 2014 which claims priority to Japanese Patent Application No. 2013-034932 filed on Feb. 25, 2013, the disclosures of each of which are incorporated herein by reference.

TECHNICAL FIELD

The present disclosure relates to a fuel injection controller and a fuel injection system. In the fuel injection controller or the fuel injection system, an injection state of fuel such as an injection start time point or an injection amount is controlled by controlling an energization of a coil of a fuel injector.

BACKGROUND

JP-2012-177303A describes that a controller relates to a fuel injector injecting fuel by a lift-up (valve-opening operation) of a valve body according to an electromagnetic attractive force generated by an energization of a coil. An opening time point of the valve body and an opening time period are controlled by controlling an energization start time point of the coil and an energization time period of the coil, and then an injection start time point and an injection amount are controlled.

As shown in FIGS. 16A to 16E, the controller executes an increase control to increase a coil current to a first target value I1 by a boost voltage that is boosted from a battery voltage and is applied to a coil. Therefore, the valve body starts to open at a time point t1 that an electromagnetic attractive force reaches a required valve-opening force Fa. In this case, a current for holding the valve body at a position corresponding to a maximum-lift position is less than the first target value. Specifically, when the electromagnetic attractive force is increased, the electromagnetic attractive force is affected by inductance due to a large variation in a magnetic field. When the electromagnetic attractive force is held to a specified value, the electromagnetic attractive force is not affected by inductance.

Thus, at a time point t20 that the coil current reaches the first target value I1, a duty control corresponding to a current-stabilizing control controls a voltage to be applied to the coil to decrease the coil current so that the coil current becomes a second target value I2 that is less than the first target value I1.

FIG. 16D is a graph showing a Ti-q property line representing a relationship between an energization time period Ti of the coil and an injection amount q in a case where the valve body is opened. A flow-throttling degree at an injecting port becomes greater than the flow-throttling degree at a seat surface of the valve body, in a normal injection area in which a lift value is greater than or equal to a predetermined value. The normal injection area corresponds to an injecting-port throttle area B2. The injection amount is determined according to a throttling of a flow at the injecting port. The flow-throttling degree at the seat surface becomes greater than the flow-throttling degree at the injecting port, in a small injection area in which the lift value is less than the predetermined value. The small injection area corresponds to a seat throttle area B1. Therefore, the injection amount is determined according to the throttling of the flow at the seat surface.

The higher a temperature of the coil becomes, the greater a resistance of the coil becomes. In this case, as dotted lines shown in FIGS. 16A and 16B, a time period from a time point t10 that a voltage starts to be applied to the coil to a time point t20 that the coil current reaches the first target value I1 becomes longer. Therefore, an increasing slope of the electromagnetic attractive force becomes gradual as shown in FIG. 16C, a valve-opening start time point t1 is delayed, and a valve-opening time period t1 to t5 becomes shorter.

In other words, when a coil temperature varies, an increasing slope of the current varies. Therefore, the increasing slope of the electromagnetic attractive force varies, and the Ti-q property line varies. When an injection state is controlled to achieve a request injection start time point and a request injection amount, a robustness of a control of the injection state is deteriorated relative to a variation in the coil temperature.

When a multi-injection in which fuel is divided to be injected for multiple times in a single combustion cycle is executed, it is required that a small amount of fuel is accurately injected. In this case, since an affect of a time lag of the injection start time point with respect to a differential amount of the injection amount is increased, an accuracy of the injection amount becomes remarkably worse due to the variation in the coil temperature.

SUMMARY

The present disclosure is made in view of the above matters, and it is an object of the present disclosure to provide a fuel injection controller and a fuel injection system. In the fuel injection controller and the fuel injection system, a robustness of a control of an injection state is improved relative to a variation in the coil temperature.

According to an aspect of the present disclosure, a fuel injection controller is applied to a fuel injector injecting fuel used in a combustion of an internal combustion engine by a valve-opening operation of a valve body according to an electromagnetic attractive force generated by an energization of a coil. The fuel injection controller controls an injection state of the fuel injector by controlling a coil current flowing through the coil.

The fuel injection controller includes a boost circuit which boosts a battery voltage to a boost voltage, an increase control portion which controls the boost voltage to be applied to the coil so as to increase the coil current to be equal to or greater than a first target value, and a constant current control portion which controls a voltage to be applied to the coil so as to reduce the coil current that is increased by the increase control portion and to hold the coil current to be applied to the coil at a second target value.

A property line represents a relationship between an energization time period of the coil and an injection amount. The valve body has a seating surface. The fuel injector has an injection port. The property line has a seat throttle area in which a flow-throttling degree at the seating surface is greater than the flow-throttling degree at the injection port, an injection-port throttle area in which the flow-throttling degree at the injection port is greater than the flow-throttling degree at the seating surface, and a threshold corresponds to an energization time period that is necessary to reach a boundary point between the seat throttle area and the injection-port throttle area from an energization start time point.

An initial-current applied time period corresponds to a time period from the energization start time point that the boost voltage starts to be applied to the coil to a time point that the coil current is decreased to the second target value. The increase control portion executes an increase control to control the coil current such that the initial-current applied time period is less than the threshold.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
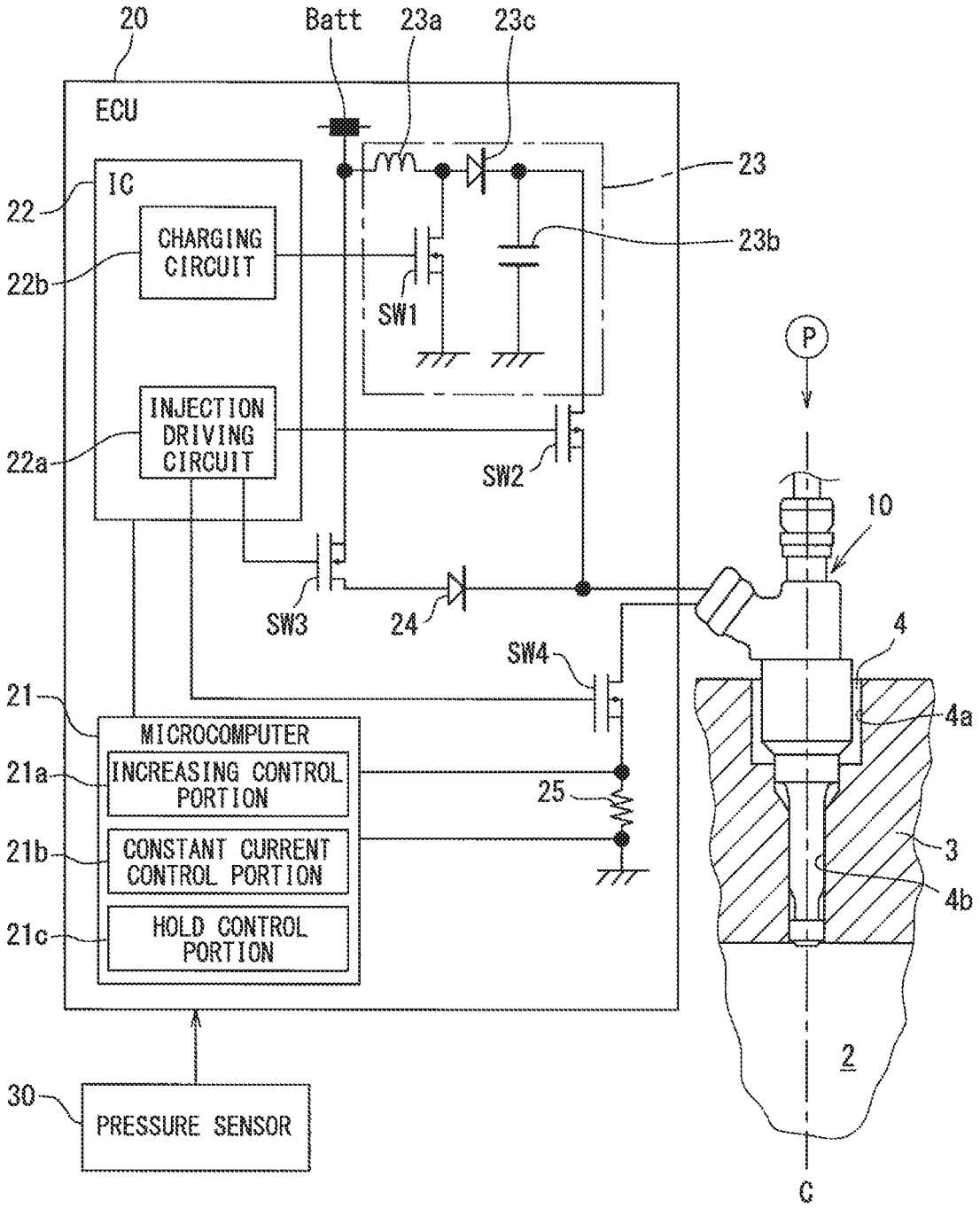
FIG. 1 is schematic diagram showing an outline of a fuel injection system having a fuel injection controller, according to a first embodiment of the present disclosure.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

Hereafter, a fuel injection controller and a fuel injection system using the fuel injection controller according to an embodiment of the present disclosure will be described referring to drawings. The substantially same parts or components as those in the embodiments are indicated with the same reference numerals and the same descriptions may be omitted. Further, it is to be understood that the disclosure is not limited to the embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

First Embodiment

As shown in FIG. 1, a fuel injector 10 is mounted to an internal combustion engine of an ignition type, and directly injects fuel into a combustion chamber 2 of the internal combustion engine. For example, the internal combustion engine may be a gasoline engine. Specifically, an attachment hole 4 for the fuel injector 10 to be inserted into is axially provided in a cylinder head 3 along an axis line C of a cylinder. The fuel supplied to the fuel injector 10 is pumped by a fuel pump P that is driven by the internal combustion engine. According to the present embodiment, the fuel pump P is mounted to a combustion system.

Figure 2:
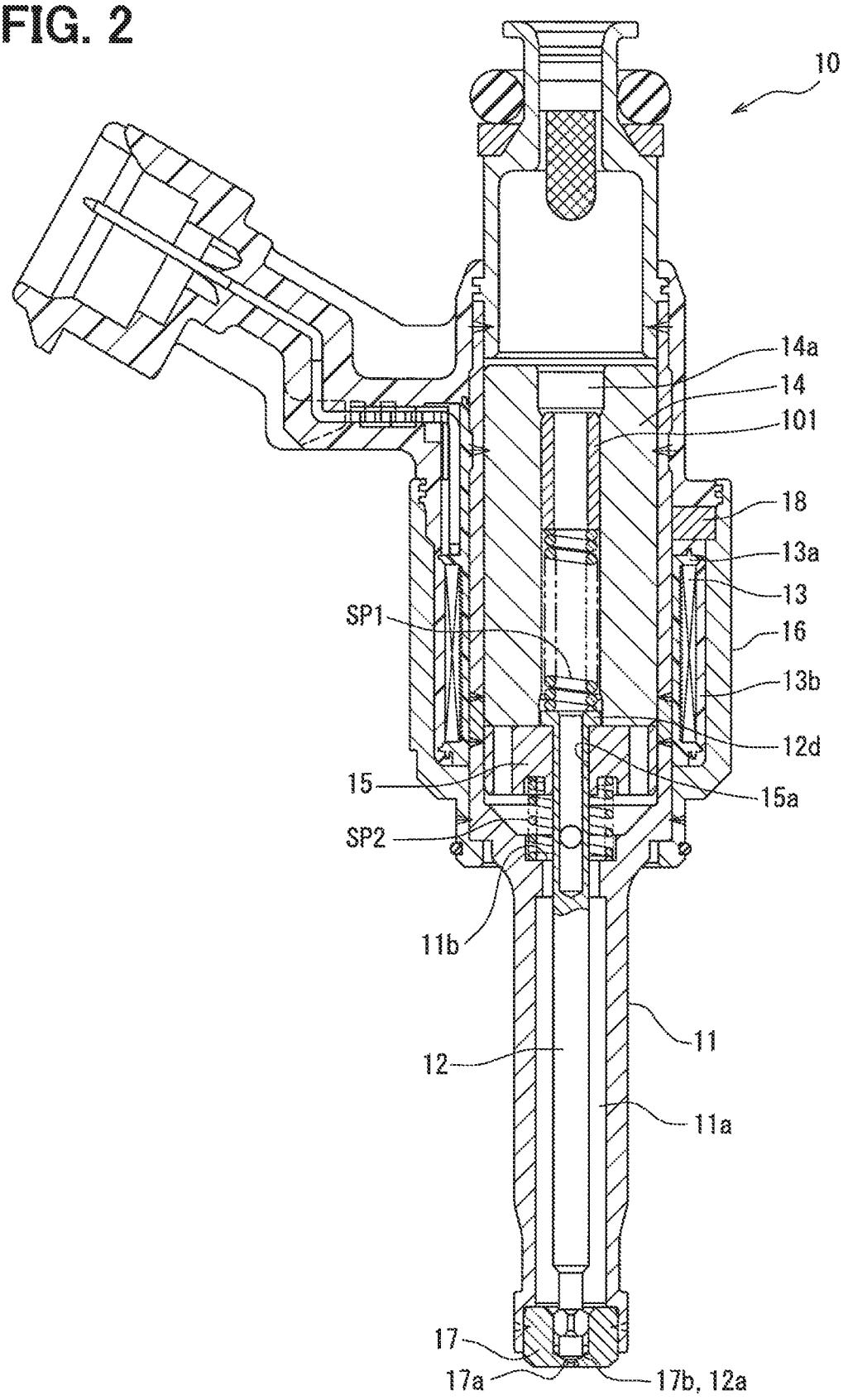
FIG. 2 is a sectional view showing an outline of a fuel injector according to the first embodiment.

As shown in FIG. 2, the fuel injector 10 includes a body 11, a valve body 12, a first coil 13, a stator core 14, a movable core 15, and a housing 16. The body 11 is made of a magnetic metal material, and includes a fuel passage 11*a*. The body 11 forms a seated surface 17*b* and an injection port 17*a*. The valve body 12 abuts on or separates from the seated surface 17*b*. The fuel is injected through the injection port 17*a*. An injection body 17 forming the injection port 17*a* is disposed at a position of the body 11 downstream of the fuel passage 11*a*.

When the valve body 12 is closed to make a seating surface 12*a* arranged at the valve body 12 abut on the seated surface 17*b*, a fuel injection from the injection port 17*a* is stopped. When the valve body 12 is opened (lifted up) to make the seating surface 12*a* separate from the seated surface 17*b*, the fuel is injected from the injection port 17*a*. The first coil 13 is configured by winding a bobbin 13*a* made of resin. The first coil 13 is sealed by the bobbin 13*a* and a resin member 13*b*. Thus, a coil body which is cylinder-shaped is constructed by the first coil 13, the bobbin 13*a* and the resin member 13*b*.

The stator core 14 is cylinder-shaped using a magnetic metal material. The stator core 14 has a fuel passage 14*a*. The stator core 14 is disposed on an inner peripheral surface of the body 11, and the bobbin 13*a* is disposed on an outer peripheral surface of the body 11. The housing 16 covers an outer peripheral surface of the resin member 13*b*. The housing 16 is cylinder-shaped using a magnetic metal material. A cover member 18 made of a magnetic metal material is placed at an opening end portion of the housing 16. Thus, the coil body is surrounded by the body 11, the housing 16 and the cover member 18.

The movable core 15 is disc-shaped using a magnetic metal material, and is disposed on the inner peripheral surface of the body 11. The body 11, the valve body 12, the coil body, the stator core 14, the movable core 15, and the housing 16 are arranged so that each axis of them is placed concentrically. The movable core 15 is placed at a position between the injection port 17*a* and the stator core 14. When the first coil 13 is deenergized, a predetermined gap between the movable core 15 and the stator core 14 is generated.

When the first coil 13 is energized to generate an electromagnetic attractive force at the stator core 14, the movable core 15 is moved towards the stator core 14 by the electromagnetic attractive force. The electromagnetic attractive force corresponds to an electromagnetic force. Therefore, the valve body 12 connected with the movable core 15 cancels an elastic force of a main spring SP1 and a fuel-pressure valve-closing force and is lifted up (valve-opening operation). When the first coil 13 is deenergized, the valve body 12 is moved together with the movable core 15 by the elastic force of the main spring SP1 (valve-closing operation).

Figure 3:
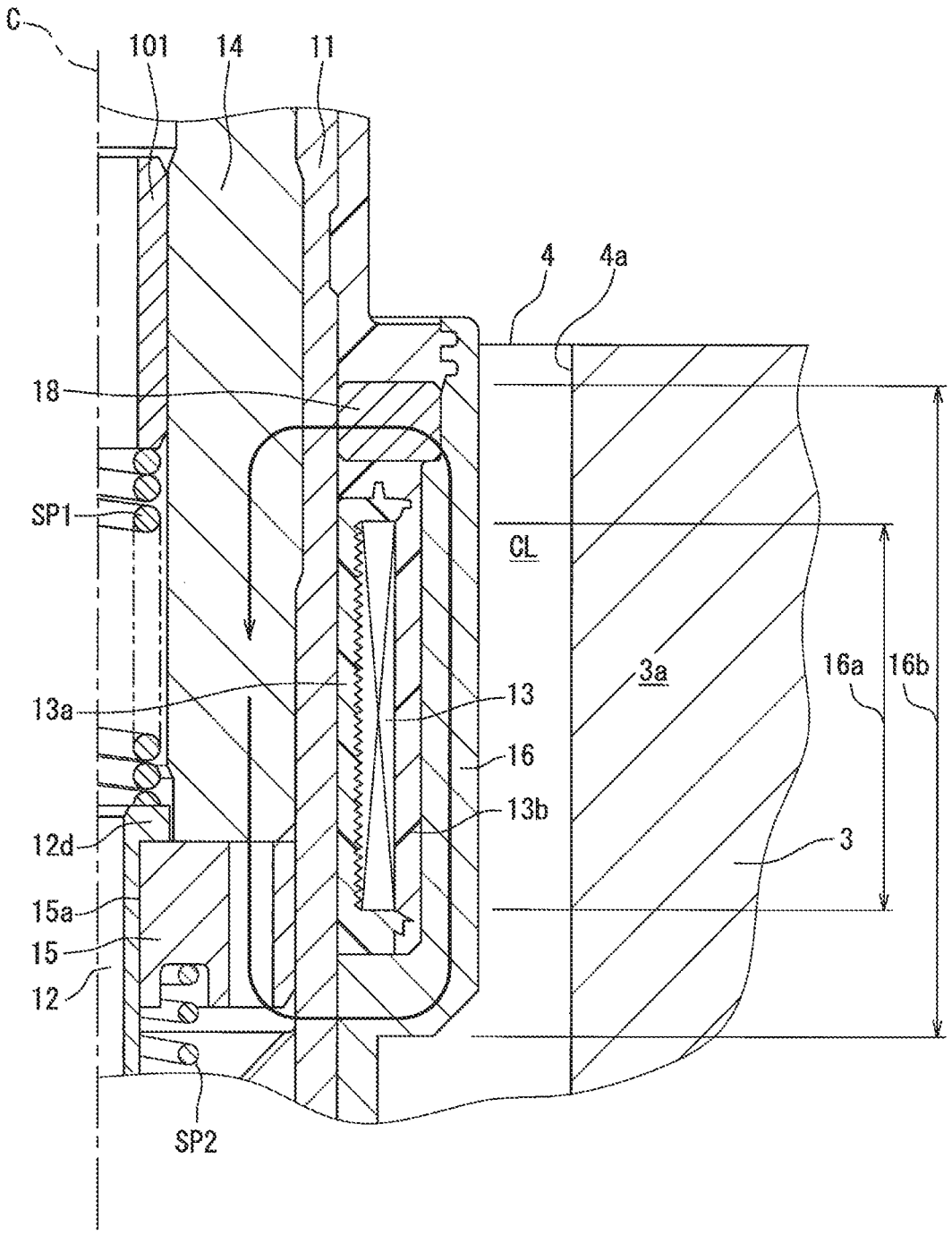
FIG. 3 is an enlarged view of FIG. 2, and shows a sectional view of a magnetic circuit.

FIG. 3 is an enlarged view showing a part of the fuel injector 10 in a condition that the fuel injector 10 is inserted into the attachment hole 4. The body 11, the housing 16, the cover member 18, the stator core 14, and the movable core 15 are made of a magnetic material, and generate a magnetic circuit as a passage of a magnetic flux. The magnetic flux is generated according to an energization of the first coil 13. That is, as an arrow shown in FIG. 3, the magnetic flux flows through the magnetic circuit.

A portion of the housing 16 which accommodates the first coil 13 is referred to as a coil portion 16*a*. A portion of the housing 16 which generates the magnetic circuit is referred to as a magnetic circuit portion 16*b*. In other words, a position of a first end surface of the cover member 18 farther from the injection port 17*a* than a second end surface of the cover member 18 in an inserting direction is an edge of the magnetic circuit portion 16*b*. As show in FIG. 3, the entire of the coil portion 16*a* and the entire of the magnetic circuit portion 16*b* are surrounded over the whole periphery by a first inner peripheral surface 4*a* of the attachment hole 4 in the inserting direction. A portion of the cylinder head 3 which surrounds over the whole periphery of the magnetic circuit corresponds to a conductive ring 3*a*. According to the present embodiment, the conductive ring 3*a* may correspond to a predetermined position of the internal combustion engine.

As shown in FIG. 1, a second inner peripheral surface 4*b* of the attachment hole 4 contacts an outer peripheral surface of a portion of the body 11. In this case, the portion of the body 11 is placed between the injection port 17*a* and the housing 16. As shown in FIG. 3, a clearance CL is formed between the outer peripheral surface of the housing 16 and the first inner peripheral surface of the attachment hole 4. That is, the outer peripheral surface of the magnetic circuit portion 16*b* and the first inner peripheral surface 4*a* of the attachment hole 4 are opposite to each other with the clearance CL.

As shown in FIG. 2, the movable core 15 forms a through hole 15*a*. The valve body 12 is inserted into the through hole 15*a* to be slidable relative to the movable core 15. The valve body 12 includes a locking portion 12*d* at an end part opposite to the injection port 17*a*. When the movable core 15 is moved towards the stator core 14, since the locking portion 12*d* locks the movable core 15, the valve body 12 is moved together with the movable core 15 to execute the valve-opening operation. Even when the movable core 15 contacts the stator core 14, the valve body 12 is slidable relative to the movable core 15 to be lifted up.

The main spring SP1 is arranged at the end part of the valve body 12 opposite to the injection port 17*a*. A sub spring SP2 is arranged at an end part of the movable core 15 close to the injection port 17*a*. The main spring SP1 and the sub spring SP2 are coil-shaped and are elastically deformable in the direction along the axis line C. The elastic force of the main spring SP1 corresponding to a main elastic force Fs1 is applied to the valve body 12 in a valve-closing direction as a reactive force of an adjusting pipe 101. An elastic force of the sub spring SP2 corresponding to a sub elastic force Fs2 is applied to the movable core 15 in a pressing direction as a reactive force of a concave portion 11*b* of the body 11. The pressing direction is a direction where the movable core 15 is pressed towards the locking portion 12*d*. The main spring SP1 and the sub spring SP2 are elastically deformable according to a movement of the valve body 12 to apply an elastic force to the valve body 12 in the valve-closing direction.

The valve body 12 is provided between the main spring SP1 and the seated surface 17*b*. The movable core 15 is provided between the sub spring SP2 and the locking portion 12*d*. The sub elastic force Fs2 of the sub spring SP2 is transmitted to the locking portion 12*d* via the movable core 15 and is applied to the valve body 12 in a valve-opening direction. Therefore, a computed elastic force Fs that is subtracting the sub elastic force Fs2 from the main elastic force Fs1 is applied to the valve body 12 in the valve-closing direction.

As shown in FIG. 1, an electronic control unit (ECU) 20 includes a microcomputer 21, an integrated circuit (IC) 22, a boost circuit 23, and switching elements SW2, SW3 and SW4.

Figure 4A:
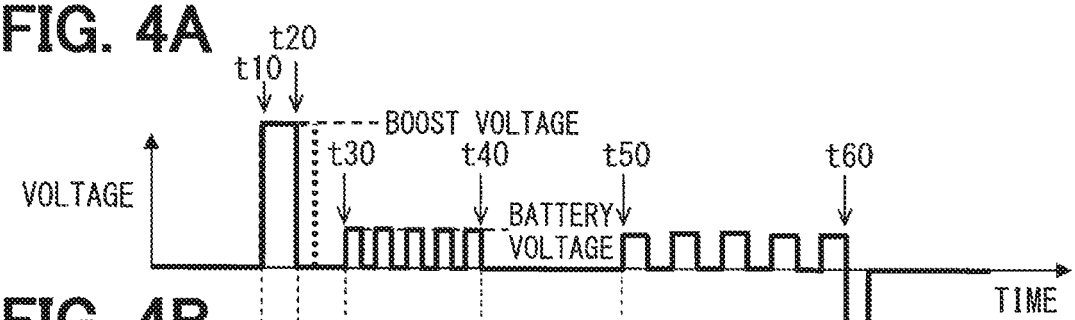
FIG. 4A is a graph showing a relationship between a voltage applied to a coil and time.

The microcomputer 21 includes a central processing unit, a nonvolatile memory (ROM), and a volatile memory (RAM). The microcomputer 21 computes a target injection amount and a target injection-start time, based on a load of the internal combustion engine and a rotational speed of the internal combustion engine. Further, an injection property representing a relationship between an energization time period Ti and an injection amount q is predefined by test. Therefore, the microcomputer 21 controls the energization time period Ti according to the injection property to control the injection amount q. The energization time period Ti is a time period where the first coil is energized. As shown in FIG. 4A, the first coil 13 is energized at a time point t10, and is deenergized at a time point t60. In this case, the time point t10 corresponds to an energization start time point t10, and the time point t60 corresponds to an energization stop time point t60.

The IC 22 includes an injection driving circuit 22*a* and a charging circuit 22*b*. The injection driving circuit 22*a* controls the switching elements SW2, SW3, and SW4. The charging circuit 22*b* controls the boost circuit 23. The injection driving circuit 22*a* and the charging circuit 22*b* are operated according to an injection command signal outputted from the microcomputer 21. The injection command signal, which is a signal for controlling an energizing state of the first coil 13, is set by the microcomputer 21 based on the target injection amount, the target injection start time point, and a coil current value I. The injection command signal includes an injection signal, a boost signal, and a battery signal.

The boost circuit 23 includes a second coil 23*a*, a condenser 23*b*, a first diode 23*c*, and a first switching element SW1. When the charging circuit 22*b* repeatedly turns on or turns off the first switching element SW1, a battery voltage applied from a battery terminal Batt is boosted by the second coil 23*a*, and is accumulated in the condenser 23*b*. In this case, the battery voltage after being boosted and accumulated corresponds to a boost voltage.

When the injection driving circuit 22*a* turns on both a second switching element SW2 and a fourth switching element SW4, the boost voltage is applied to the first coil 13. When the injection driving circuit 22*a* turns on both a third switching element SW3 and the fourth switching element SW4, the battery voltage is applied to the first coil 13. When the injection driving circuit 22*a* turns off the switching elements SW2, SW3 and SW4, no voltage is applied to the first coil 13. When the second switching element SW2 is turned on, a second diode 24 shown in FIG. 1 is for preventing the boost voltage from being applied to the third switching element SW3.

A shunt resistor 25 is provided to detect a current flowing through the fourth switching element SW4, that is, the shunt resistor 25 is provided to detect a current (coil current) flowing through the first coil 13. The microcomputer 21 computes the coil current value I based on a voltage decreasing amount according to the shunt resistor 25.

Hereafter, an electromagnetic attractive force (valve-opening force) generated by the coil current will be described.

The electromagnetic attractive force increases in accordance with an increase in magnetomotive force (ampere turn AT) generated in the stator core 14. Specifically, in a condition where a number of turns of the first coil 13 is fixed, the electromagnetic attractive force increases in accordance with an increase in ampere turn AT. An increasing time period is necessary for the electromagnetic attractive force to be saturated and become the maximum value since the first coil 13 is energized. According to the embodiment, the maximum value of the electromagnetic attractive force is referred to as a static attractive force Fb.

In addition, the electromagnetic attractive force required for starting to open the valve body 12 is referred to as a required valve-opening force Fa. The required valve-opening force increases in accordance with an increase in pressure of the fuel supplied to the fuel injector 10. Further, the required valve-opening force may be increased according to various conditions such as an increase in viscosity of fuel. The maximum value of the required valve-opening force is referred to as the required valve-opening force Fa.

FIG. 4A shows a waveform of a voltage applied to the first coil 13 in a case where the fuel injection is executed once. In addition, a solid line represents a waveform in case where a coil temperature is a normal temperature, and a dotted line represents a waveform in a case where the coil temperature is a high temperature. In this case, the high temperature is greater than the normal temperature.

Figure 4B:
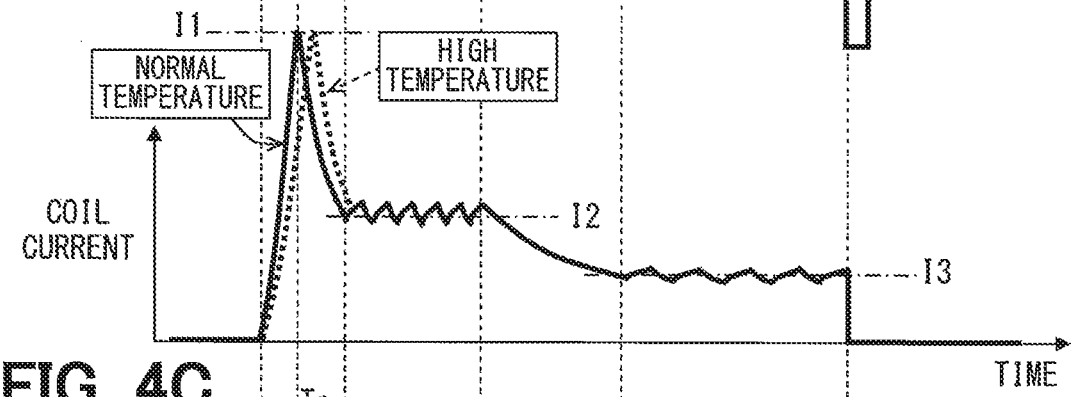
FIG. 4B is a graph showing a relationship between a coil current and time.

At the time point t10, the boost voltage is applied to the first coil 13 so that the first coil 13 starts to be energized. As shown in FIG. 4B, the coil current is increased when the first coil 13 starts to be energized. The energization of the first coil 13 is turned off at the time point t20 that the coil current value I reaches the first target value I1. The coil current is increased to the first target value I1 by the boost voltage that is applied to the first coil 13, according to the energization for the first time. In this case, the microcomputer 21 controlling as above corresponds to an increase control portion 21*a*.

Next, the first coil 13 is controlled by the battery voltage to hold the coil current at a second target value I2 that is less than the first target value I1. Specifically, a duty control is executed so that a difference between the coil current value I and the second target value I2 is in a predetermined range. In the duty control, an on-off energization of the battery voltage is repeated since a time point t30 to hold an average value of the coil current at the second target value I2. In this case, the microcomputer 21 controlling as above corresponds to a constant current control portion 21*b*. The second target value I2 is set to a value so that the static attractive force Fb is greater than or equal to the required valve-opening force Fa.

Next, the first coil 13 is controlled by the battery voltage to hold the coil current at a third target value I3 that is less than the second target value I2. Specifically, a duty control is executed so that a difference between the coil current value I and the third target value I3 is in a predetermined range. In the duty control, an on-off energization of the battery voltage is repeated since a time point t50 to hold an average value of the coil current at the third target value I3. In this case, the microcomputer 21 controlling as above corresponds to a hold control portion 21*c*.

Figure 4C:
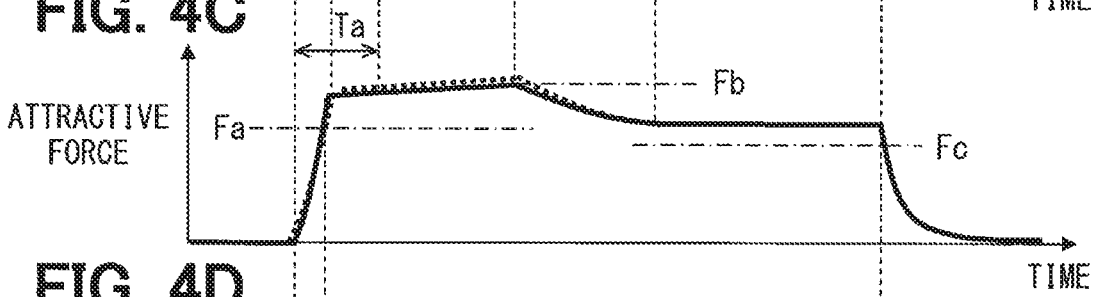
FIG. 4C is a graph showing a relationship between an electromagnetic attractive force and time.

As shown in FIG. 4C, the electromagnetic attractive force is continuously increased during a time period from the time point t10 to a time point t40 that a constant current control is completed. In this case, the time point t10 corresponds to an increase start time point t10, and the constant current control holds the coil current at a constant value. An increasing rate of the electromagnetic attractive force during a constant current control time period from the time point t30 to the time point t40 is less than the increasing rate of the electromagnetic attractive force during an increase control time period from the time point t10 to the time point t20. The first target value I1, the second target value I2, and the constant current control time period are set so that the electromagnetic attractive force is greater than the required valve-opening force Fa during the time period from the increase start time point t10 to the time point t40.

The electromagnetic attractive force is held to a predetermined force during a hold control time period from the time point t50 to the time point t60. The third target value I3 is set so that a valve-opening hold force Fc is less than the predetermined force. The valve-opening hold force Fc is necessary to hold the valve body 12 to be open. The valve-opening hold force Fc is less than the required valve-opening force Fa.

The injection signal of the injection command signal is a pulse signal dictating to the energization time period Ti. A pulse-on time point of the injection signal is set to the time point t10 by an injection delay time earlier than a target energization start time point. A pulse-off time point of the injection signal is set to the energization stop time point t60 after the energization time period Ti has elapsed since the time point t10. The fourth switching element SW4 is controlled by the injection signal.

The boost signal of the injection command signal is a pulse signal dictating to an energization state of the boost voltage. The boost signal has a pulse-on time point as the same as the pulse-on time point of the injection signal. Next, the boost signal is repeatedly turned on or off until the coil current value I reaches the first target value I1. The second switching member SW2 is controlled by the boost signal. The boost voltage is applied to the first coil 13 during the increase control time period.

The battery signal of the injection command signal is turned on at the time point t30. In this case, the time point t30 corresponds to a constant-current control start time point t30. Next, the battery signal is repeatedly turned on or off to execute a feedback control during a time period that a predetermined time has elapsed since the energization start time point t10. In this case, the feedback control holds the coil current value I at the second target value I2. Next, the battery signal is repeatedly turned on or off to execute a feedback control until the injection signal is turned off. In this case, the feedback control holds the coil current value I at the third target value I3. The third switching element SW3 is controlled by the battery signal.

Figure 4D:
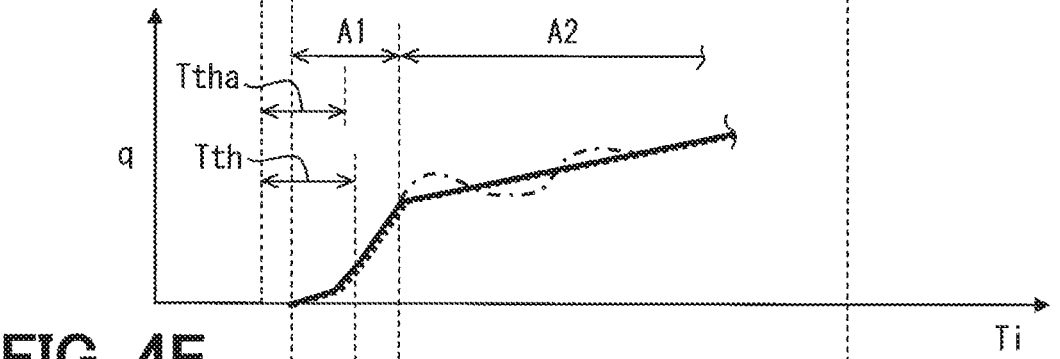
FIG. 4D is a graph showing a relationship between an injection amount and time.
Figure 4E:
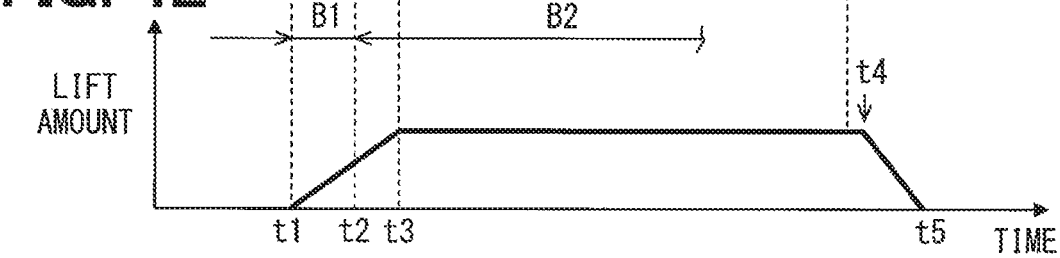
FIG. 4E is a graph showing a relationship between a lift amount and time, when an injection control is executed according to the first embodiment.

As shown in FIG. 4E, the valve body 12 starts to open at the time point t1 that the electromagnetic attractive force reaches the required valve-opening force Fa. In this case, the time point t1 is also a time point that the injection delay time has elapsed since the energization start time point t10. A time point t3 is a time point that the valve body 12 reaches a full-lift position, and a time point t4 is a time point that the valve body 12 starts to close. In this case, the full-lift position corresponds to a maximum valve-opening position of the valve body 12. In other words, the valve body 12 starts to close at a time point that a valve-closing start delay time period has elapsed since the energization stop time point t60. In this case, the time point corresponds to the time point t4 that the electromagnetic attractive force becomes less than the valve-opening hold force Fc.

As shown in FIG. 4A, a negative voltage is applied to the first coil 13 right after the time point t60. Since the coil current flows in an opposite direction opposite to a direction of the coil current in the energization time period Ti, a valve-closing rate of the valve body 12 is increased. In this case, the energization time period Ti is a time period from the time point t10 to the time point t60. A valve-closing delay time period from the energization stop time point t60 to a time point t5 that the valve body 12 is completely closed can be shortened.

As shown in FIG. 4D, when the valve body 12 starts to open, an integration value of the fuel injection amount starts to increase. In this case, the integration value corresponds to the injection amount q. As shown in FIG. 4D, an area B1 from the time point t1 to a time point t2 corresponds to a seat throttle area B1 in which the flow is throttled at a gap between the seating surface 12*a* and the seated surface 17*b*. In this case, the injection amount is determined by a throttling of a flow at the seating surface 12*a* corresponding to a flow-throttling degree at the seating surface 12*a*. Further, an area B2 after the time point t2 corresponds to an injection-port throttle area B2 in which the flow is throttled at the injection port 17*a*. In this case, the injection amount is determined by the throttling of the flow at the injection port 17*a* corresponding to the flow-throttling degree at the injection port 17*a*.

In the fuel injector 10 according to the present embodiment, a slope of the Ti-q property line in the seat throttle area B1 is greater than the slope of the Ti-q property line in the injection-port throttle area B2. In other words, in the seat throttle area B1, the slop of the Ti-q property line varies gradually.

A pressure (fuel pressure) Pc of the fuel supplied to the fuel injector 10 is detected by a pressure sensor 30 shown in FIG. 1. The ECU 20 determines whether to execute the constant current control according to the fuel pressure Pc. For example, when the fuel pressure Pc is greater than or equal to a predetermined threshold Pth, the constant current control is permitted. When the fuel pressure Pc is less than the predetermined threshold Pth, the hold control is executed instead of the constant current control, after an increase control is executed. The increase control increases the coil current to the first target value I1.

As shown in FIGS. 4D and 4E, the slope of the Ti-q property line becomes smaller after the time point t3. An area from the time point t1 to the time point t3 is referred to as a partial area A1, and an area after the time point t3 is referred to as a full-lift area A2. In other words, in the partial area A1, the valve body 12 starts to close before the valve body 12 reaches the full-lift position, and a minute amount of the fuel is injected.

As the above description, the fuel injection controller has the following features. Further, effects of the features will be described.

Figure 5:
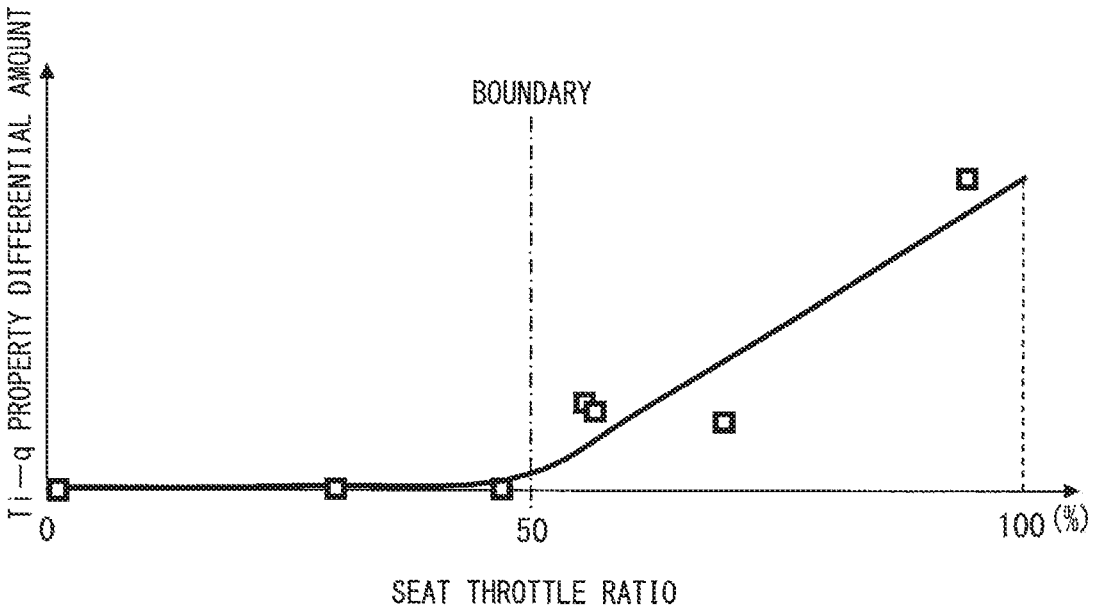
FIG. 5 is a graph showing a test result about a relationship between a seat throttle ratio of when an initial-current applied time period Ta is completed and a Ti-q property differential amount, according to the first embodiment.
Figure 6:
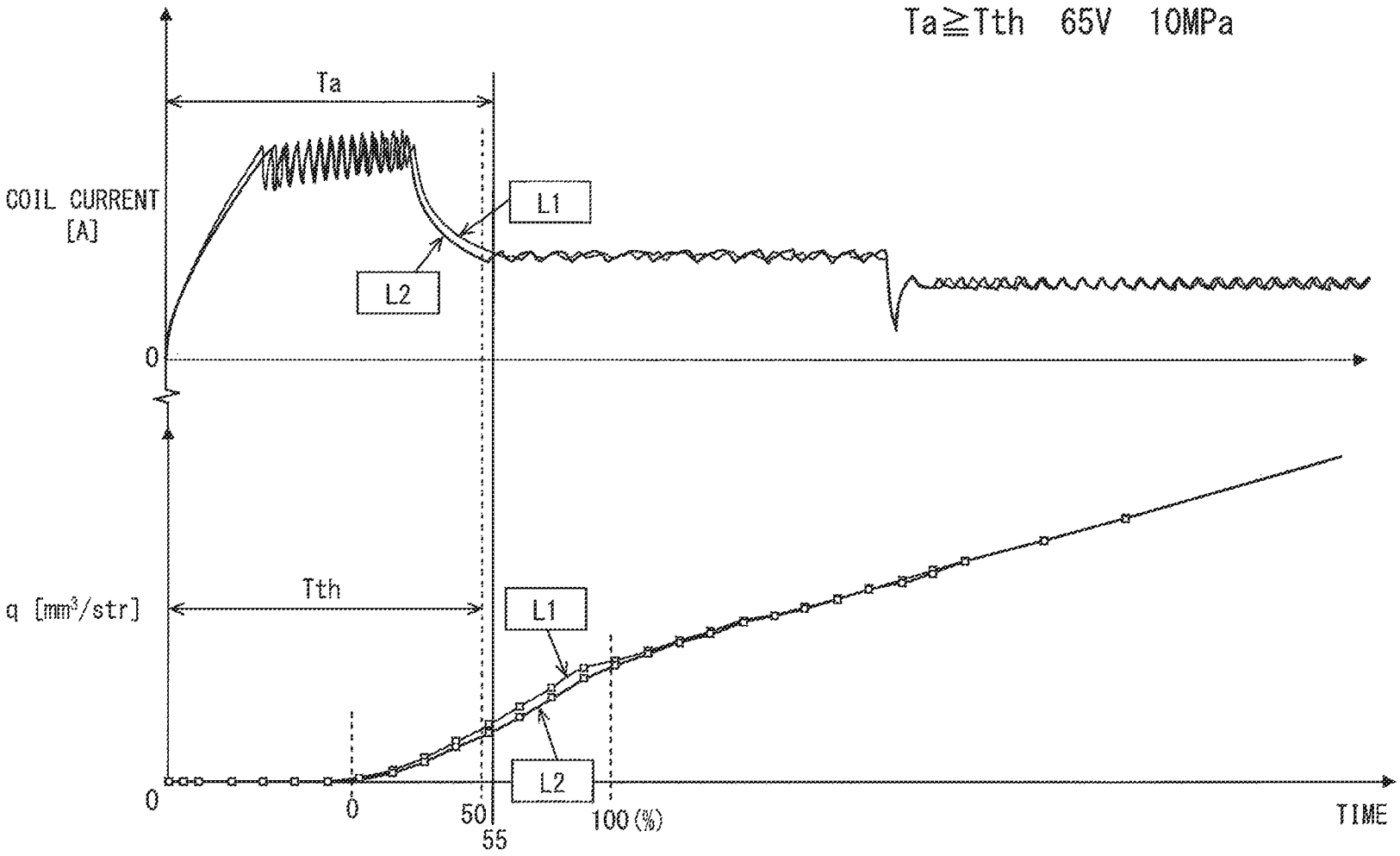
FIG. 6 is a graph showing the Ti-q property differential amount in a condition that Ta≥Tth.
Figure 7:
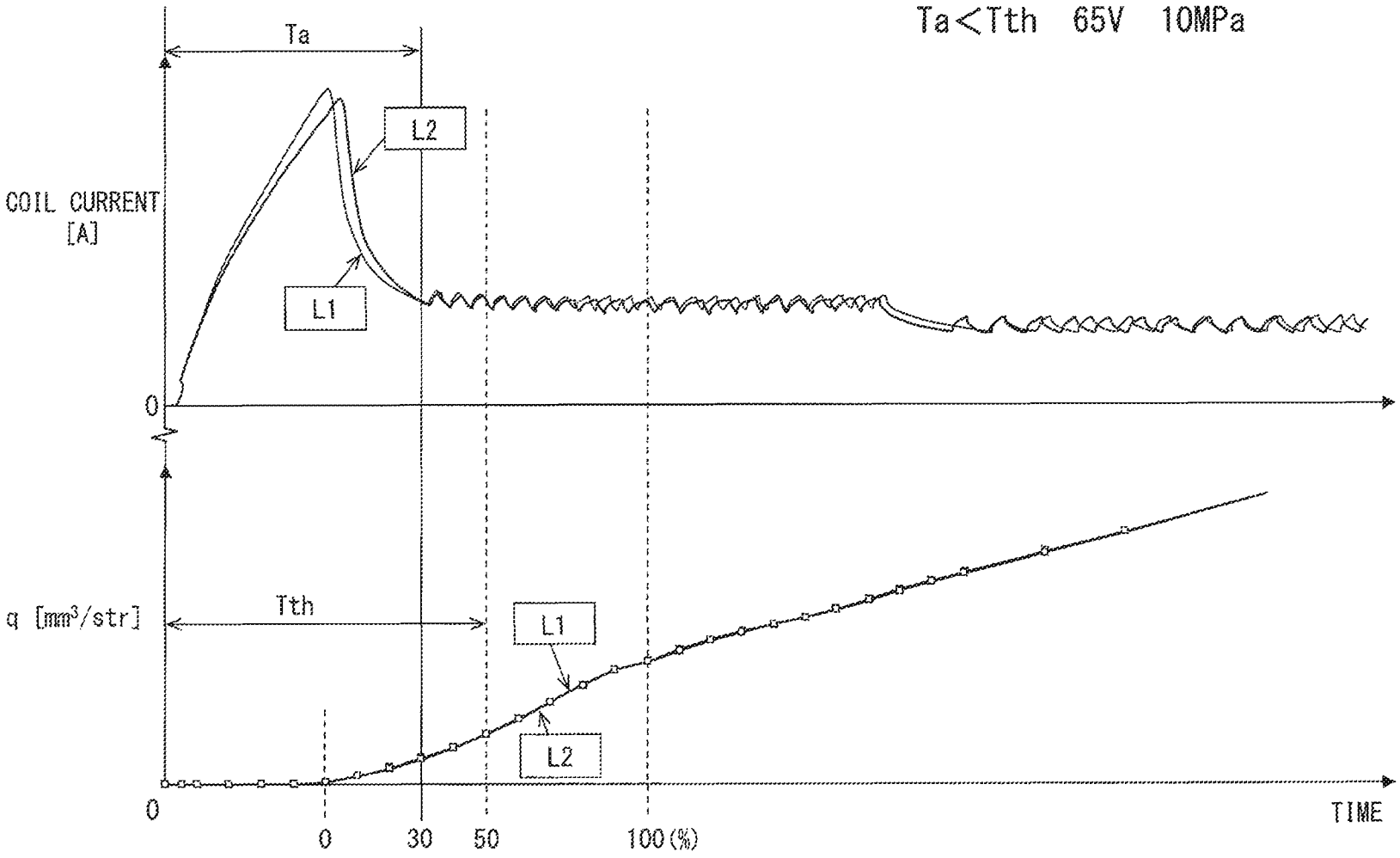
FIG. 7 is a graph showing the Ti-q property differential amount in a condition that Ta<Tth.

(a) The increase control portion 21*a* controls the coil current such that an initial-current applied time period Ta is less than or equal to a threshold Tth that is predetermined. The threshold Tth corresponds to the energization time period Ti that is necessary to reach a boundary point between the seat throttle area B1 and the injection-port throttle area B2 from the time point t10. According to the present embodiment, the boundary point corresponds to the time point t2. According to the present embodiment, the initial-current applied time period Ta is less than the threshold Tth. As shown in FIGS. 5 to 7, a temperature property variation corresponding to the variation of the Ti-q property line with respect to a variation in the coil temperature is remarkably restricted, and a robustness of a control of an injection state is improved relative to the variation in the coil temperature. In this case, the control of the injection state corresponds to an injection control.

FIGS. 5 to 7 show a test result that the temperature property variation can be remarkably restricted when the initial-current applied time period Ta is less than the threshold Tth. The threshold Tth corresponds to the energization time period Ti that is necessary to reach the boundary point between the seat throttle area B1 and the injection-port throttle area B2 from the time point t10. In this case, the boundary point is a time point that a seat throttle ratio is 50%. FIGS. 6 and 7 show test results in a case where the fuel pressure Pc is set to 10 MPa. Even when the fuel pressure Pc is set to 20 MPa, a Ti-q property differential amount sharply decreases since the time point that the seat throttle ratio is 50%. Further, FIG. 6 shows test results in a condition that the initial-current applied time period Ta is greater than or equal to the threshold Tth, and FIG. 7 shows test results in a condition that the initial-current applied time period Ta is less than the threshold Tth.

FIGS. 6 and 7 show test results about waveforms of a coil current varying according to time and about the Ti-q property lines. As shown in FIGS. 6 and 7, lines L1 are test results that the coil temperature is the normal temperature, and lines L2 are test results that the coil temperature is the high temperature. As shown in FIG. 6, when the initial-current applied time period Ta is long, the temperature property variation occurs. As shown in FIG. 7, when the initial-current applied time period Ta is short, no temperature property variation occurs.

When the valve body is sufficiently lifted up, a flow-throttling degree at the injection port is greater than the flow-throttling degree at the seating surface. The flow-throttling degree at the injection port corresponds to a fuel-pressure loss generated at the injection port, and the flow-throttling degree at the seating surface corresponds to the fuel-pressure loss generated at the seating surface. Further, the fuel-pressure loss generated at the injection port is referred to as an injection-port pressure loss, and the fuel-pressure loss generated at the seating surface is referred to as a seat pressure loss. The injection amount is determined by the injection-port pressure loss. When the lift amount is small right after the valve body starts to open, the flow-throttling degree at the seating surface is greater than the flow-throttling degree at the injection port. The injection amount is determined by the seat pressure loss. The seat throttle ratio is a ratio of the seat pressure loss relative to a sum of the seat pressure loss and the injection-port pressure loss.

Figure 8:
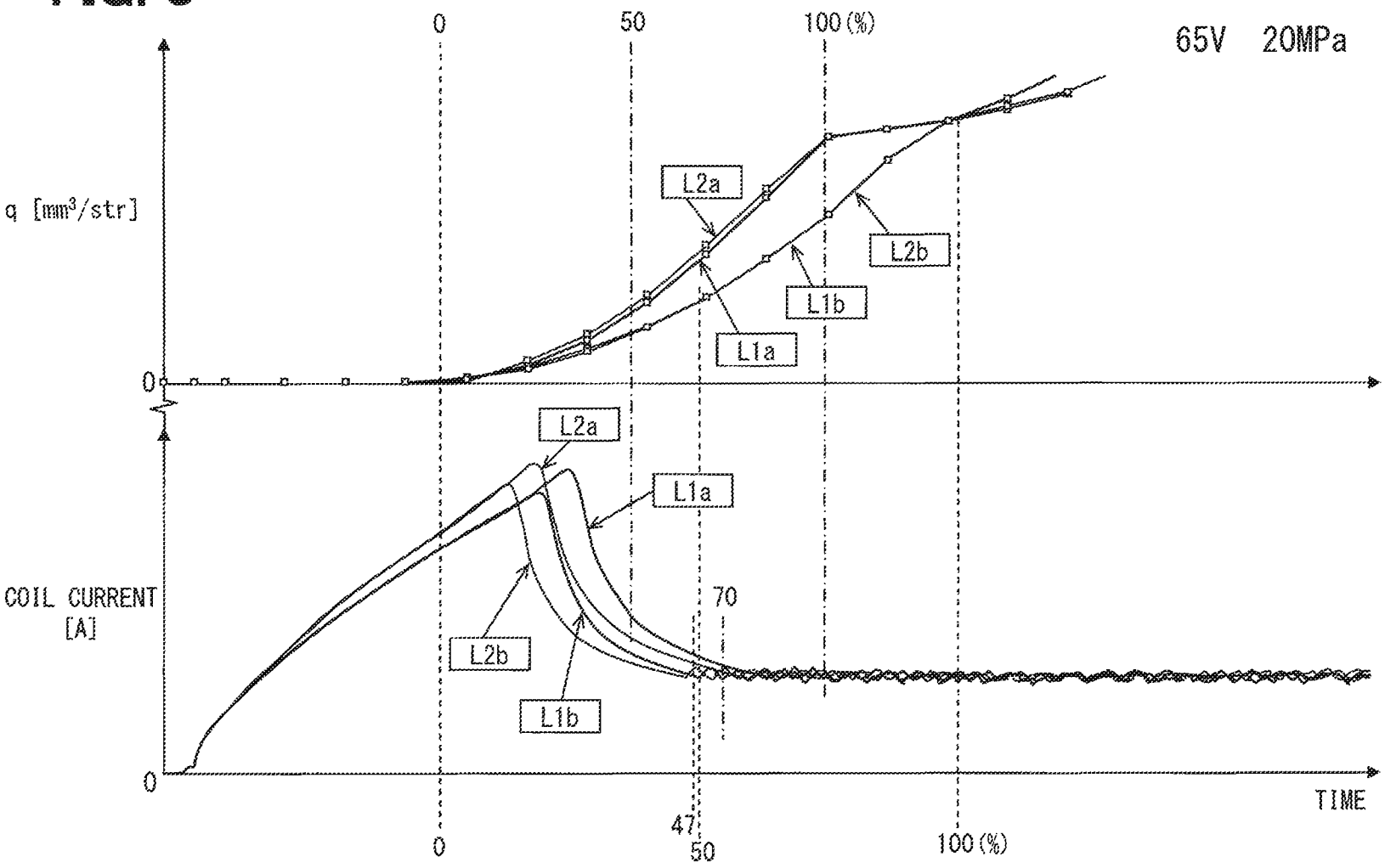
FIG. 8 is a graph showing a test result in a condition that a fuel pressure is different from FIGS. 6 and 7.

FIG. 8 shows test results that the fuel pressure Pc is set to 20 MPa. Lines Da and L2*a* are test results that the initial-current applied time period Ta is greater than or equal to the threshold Tth and the energization time period is necessary to reach 70% of the seat throttle area. Lines L1*b* and L2*b* are test results that the initial-current applied time period Ta is less than the threshold Tth and the energization time period is necessary to reach 47% of the seat throttle area. Further, the lines Da and L1*b* are test results that the coil temperature is the high temperature, and the lines L2*a* and L2*b* are test results that the coil temperature is the normal temperature. As shown in FIG. 8, even though the fuel pressure is set to 20 MPa, when the initial-current applied time period Ta is greater than or equal to the threshold Tth, a variation is generated in the Ti-q property line. When the initial-current applied time period Ta is less than the threshold Tth, no variation is generated in the Ti-q property line.

Even when the boost voltage is different, the Ti-q property differential amount sharply decreases since the time point that the seat throttle ratio is 50%. FIGS. 6 and 7 show test results that the boost voltage applied to the first coil 13 is set to 65V. Further, a test that the boost voltage is set to 40V is also executed.

Figure 9:
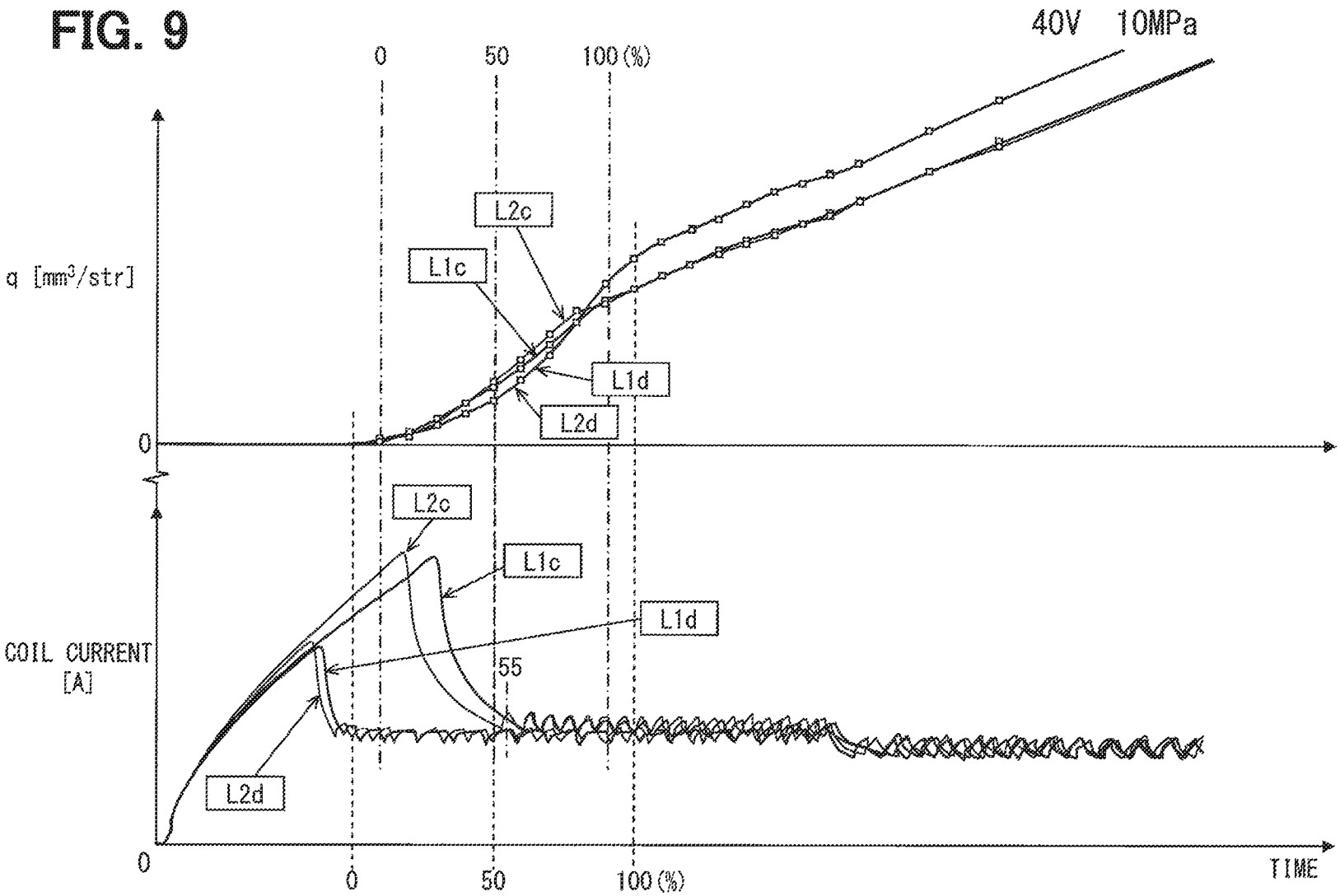
FIG. 9 is a graph showing a test result in a condition that a voltage is different from FIGS. 6 and 7.
Figure 10A:
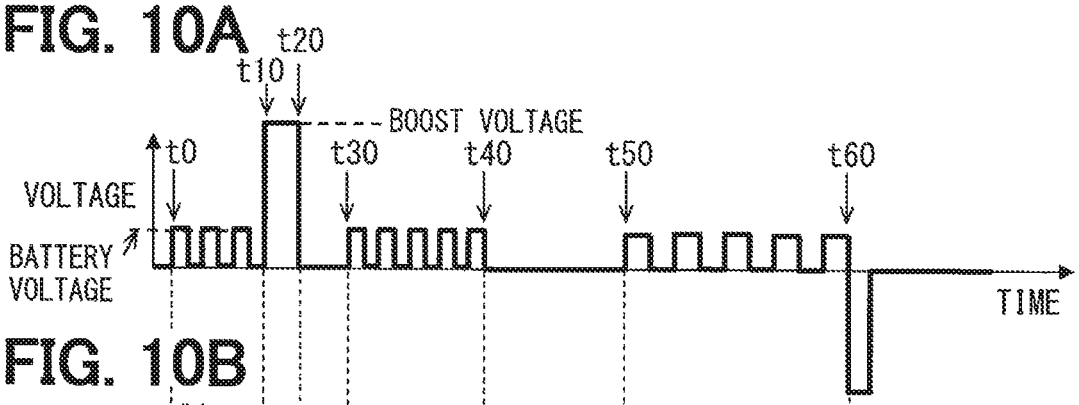
FIG. 10A is a graph showing a relationship between a voltage applied to a coil and time.
Figure 10B:
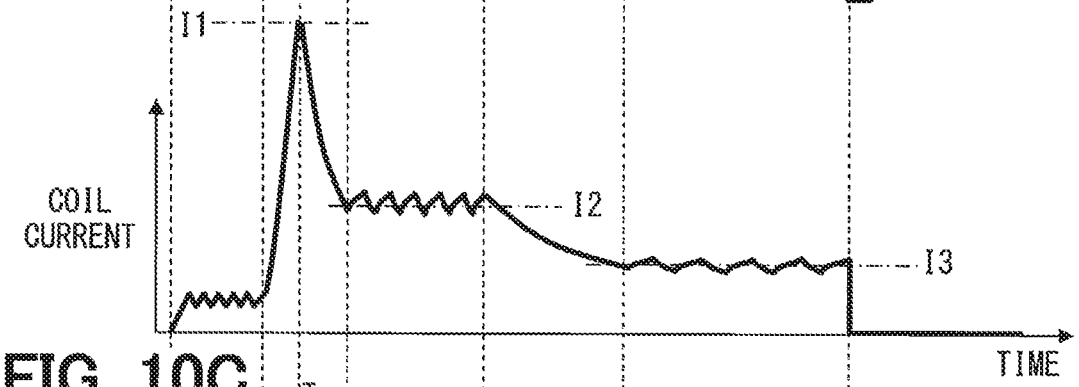
FIG. 10B is a graph showing a relationship between a coil current and time.
Figure 10C:
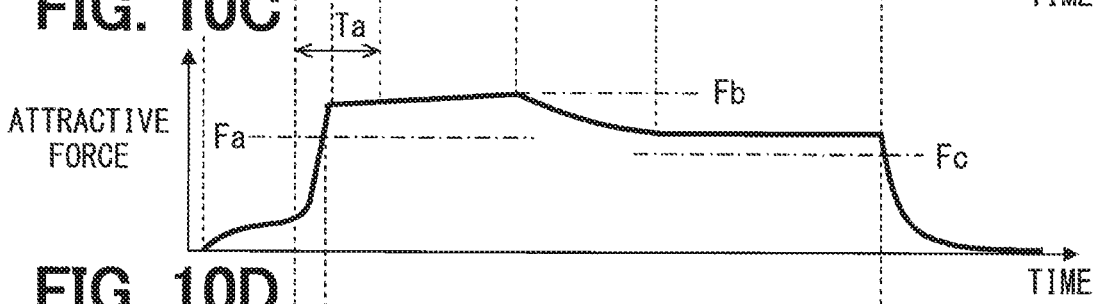
FIG. 10C is a graph showing a relationship between an electromagnetic attractive force and time.
Figure 10D:
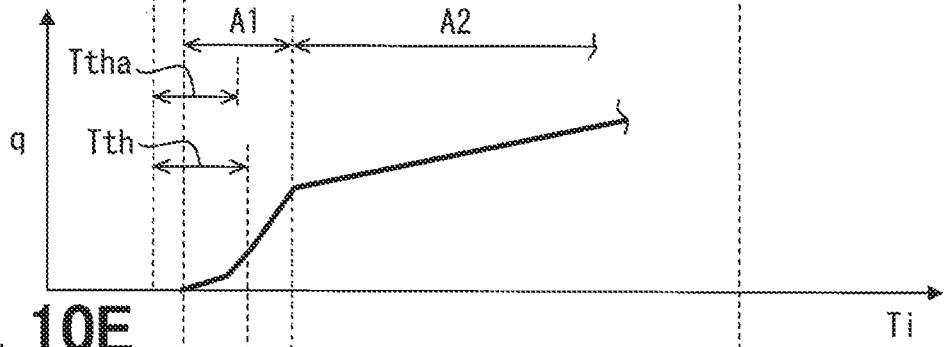
FIG. 10D is a graph showing a relationship between an injection amount and time.
Figure 10E:
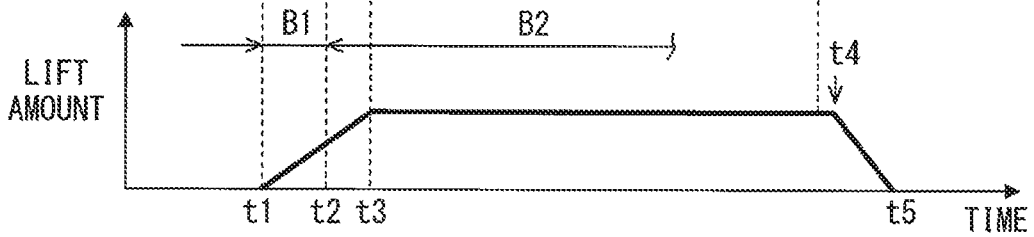
FIG. 10E is a graph showing a relationship between a lift amount and time, when an injection control is executed according to a second embodiment of the present disclosure.

FIG. 9 shows test results that the boost voltage is set to 40V. Lines L1*c* and L2*c* are test results that the initial-current applied time period Ta is greater than or equal to the threshold Tth and the energization time period is necessary to reach 55% of the seat throttle area. Lines L1*d* and L2*d* are test results that the initial-current applied time period Ta is less than the threshold Tth and the first coil 13 is deenergized before the valve body 12 starts to open. Further, the lines L1*c* and L1*d* are test results that the coil temperature is the high temperature, and the lines L2*c* and L2*d* are test results that the coil temperature is the normal temperature. As shown in FIG. 9, even though the boost voltage is set to 40V, when the initial-current applied time period Ta is greater than or equal to the threshold Tth, a variation is generated in the Ti-q property line. When the initial-current applied time period Ta is less than the threshold Tth, no variation is generated in the Ti-q property line.

Hereafter, test results shown in FIG. 5 will be described. A vertical axis represents the Ti-q property differential amount, and a horizontal axis represents the seat throttle ratio of when an initial-current applied time period Ta is completed. The movable core 15 is more readily affected according to a magnetic flux line generated by the stator core 14 in accordance with a decrease in gap between the stator core 14 and the movable core 15. Therefore, a variation of the electromagnetic attractive force due to the coil temperature increases in accordance with the decrease in gap. When the coil current is sharply increased to increase the electromagnetic attractive force while the gap is large, the variation of the electromagnetic attractive force due to the coil temperature becomes smaller. Therefore, the temperature property variation decreases in accordance with a decrease in initial-current applied time period Ta.

According to the present embodiment, a material of the first coil 13 is selected such that a resistance of the first coil 13 is small to meet a condition that the initial-current applied time period Ta is short and is less than the threshold Tth.

(b) As shown in FIG. 4A, since the coil current flows in the opposition direction right after the time point t60 that the first coil 13 is deenergized, the valve-closing rate of the valve body 12 is increased, and the valve-closing delay time period is shortened. When the coil current flows in the opposite direction during a decreasing time period from the time point t20 to the time point t30, a decreasing rate of the coil current can be increased. In the decreasing time period, the coil current is decreased from the first target value I1 to the second target value I2. Thus, when the coil current flows in the opposite direction during a decreasing time period, the coil current can be rapidly decreased to the second target value I2.

However, when the initial-current applied time period Ta is shortened to be less than the threshold Tth, an increasing rate of the coil current according to the increase control is necessary to be increased. Therefore, a heat generation of the ECU 20 becomes larger, and parts of the ECU 20 may be damaged due to the heat generation.

According to the present embodiment, the coil current is prohibited from flowing in the opposite direction during the decreasing time period. Therefore, the heat generation of the ECU 20 can be restricted, and a damage to parts of the ECU 20 can be reduced.

(c) When the valve body 12 is lifted up to the maximum valve-opening position, the movable core 15 collides with the stator core 14. Therefore, a bounce of the movable core 15 may occur relative to the stator core 14. Specifically, the movable core 15 instantly moves in the valve-closing direction according to a reaction of a collision between the movable core 15 and the stator core 14, and the movable core 15 collides with the stator core 14 again. Then, a stroke variation amount is generated by the bounce of the movable core 15. As shown in FIG. 4D, a pulse is generated as a dashed-dotted line relative to the Ti-q property line, and an accuracy of an injection-amount control is deteriorated. When the initial-current applied time period Ta is shortened to be less than the threshold Tth, a speed of the movable core 15 is increased, and an occurrence of the bounce is increased.

According to the present embodiment, the movable core 15 is movable relative to the valve body 12. Therefore, a condition that the initial-current applied time period Ta is shortened to be less than the threshold Tth can be applied to the fuel injector 10 having the sub spring SP2 applying the sub elastic force Fs2 to the movable core 15 in the valve-opening direction. Since only the valve body 12 is lifted up when the movable core 15 abuts on the stator core 14, the bounce of the movable core 15 occurred relative to the stator core 14 is restricted. Therefore, the occurrence of the bounce is reduced.

(d) As the above description, the body 11, the housing 16, the cover member 18, the stator core 14, and the movable core 15 generate the magnetic circuit. An adjacent member adjacent to the coil body includes the body 11, the housing 16, and the cover member 18. A non-adjacent member that is not adjacent to the coil body includes the stator core 14 and the movable core 15. An electrical resistivity of the adjacent member is greater than that of the non-adjacent member. The electrical resistivity corresponds to a specific electrical resistance p. For example, the adjacent member may be made of a sintered material, and the non-adjacent member may be made of an ingot material. The sintered material is formed by pressing metal powders, and the ingot material is formed by melting a metal.

Since the electrical resistivity of the adjacent member is increased, an eddy current generated in the magnetic circuit according to the energization of the first coil 13 can be canceled. Therefore, the increasing rate of the coil current can be increased while the coil current is increased by the increase control portion 21*a*, and the decreasing rate of the coil current can be increased from the first target value to the second target value. In other words, the condition that the initial-current applied time period Ta is shortened to be less than the threshold Tth can be readily achieved.

(e) According to the present embodiment, an outer peripheral surface of at least a part of the coil portion 16*a* is surrounded by the first inner peripheral surface 4*a* over the whole periphery. Since a temperature of the cylinder head 3 becomes a high temperature, the coil temperature readily becomes the high temperature in a case where the coil portion 16*a* is surrounded by the attachment hole 4. The variation in the coil temperature becomes large, and the temperature property variation may occur.

According to the present embodiment, since the coil portion 16*a* is surrounded by the cylinder head 3 having the high temperature, the robustness of the control of the injection state is improved relative to the variation in the coil temperature.

Further, a cylinder block may be used instead of the cylinder head 3 to surround the coil portion 16*a*.

(f) The increase control portion 21*a* controls the coil current to meet the condition that the initial-current applied time period Ta is less than the threshold Tth, in a case where a multi-injection in which fuel is divided to be injected for multiple times in a single combustion cycle is executed, or a case where the internal combustion engine is operating in an idle operation. The increasing slope of the injection amount q in the seat throttle area B1 is sharper than that in the injection-port throttle area B2. Therefore, the temperature property variation is readily generated. Since the injection amount is small when the multi-injection is executed or the internal combustion engine is operating in the idle operation, it is a high probability that the internal combustion engine operates in the seat throttle area B1. Therefore, the robustness of the control of the injection state is improved relative to the variation in the coil temperature.

Further, when the internal combustion engine is operating other than the multi-injection and the idle operation, the coil current is decreased from the first target value I1, and the coil current is held to the second target value I2 by the constant current control portion 21*b*. Therefore, an energy applied to the first coil 13 is reduced, and a circuit load of the ECU 20 can be reduced.

(g) When the initial-current applied time period Ta is shortened to be less than the threshold Tth, the increasing rate of the coil current according to the increase control is necessary to be increased. Therefore, a heat generation generated in the boost circuit 23 becomes large, or the coil temperature becomes high. According to the present embodiment, as shown in FIGS. 4A and 4B, the battery voltage is used when the coil current is held to the second target value I2 by the constant current control portion 21*b*. Therefore, the heat generation of the boost circuit 23 can be reduced, and a damage of the boost circuit 23 due to the heat generation can be reduced. Further, since an increasing of the coil temperature is restricted, the variation in the coil temperature can be reduced, and the occurrence of the temperature property variation can be reduced.

Second Embodiment

As shown in FIGS. 10A to 10E, according to a second embodiment, a pre charge control is executed by the microcomputer 21 before the boost voltage is applied to the first coil 13 by the increase control portion 21*a*. In this case, the microcomputer 21 corresponds to a pre charge control portion. In the pre charge control, the battery voltage is applied to the first coil 13. Specifically, the pre charge control starts at a time point t0 that is set at a predetermined time period before the increase start time point t10. Therefore, the electromagnetic attractive force starts to increase before the increase control starts. In addition, when the pre charge control is executed, the microcomputer 21 corresponds to the pre charge control.

A time period that the boost voltage is applied to the first coil 13 to increase the coil current to the first target value I1 in the increase control can be shortened. Therefore, a heat-generation amount of the boost circuit 23 having the ECU 20 can be reduced, and a damage of the ECU 20 due to the heat generation can be reduced.

According to the present embodiment, the pre charge control is permitted in a condition that the pressure of the fuel supplied to the fuel injector 10 is greater than or equal to a predetermined pressure. In this case, the pressure of the fuel supplied to the fuel injector 10 is referred to as a supplied pressure. Specifically, when the fuel pressure Pc is less than the predetermined pressure, the pre charge control is permitted. Since the fuel pump P is driven by the internal combustion engine, the supplied pressure varies in accordance with the rotational speed of the internal combustion engine. The pre charge control may be permitted in a condition that the rotational speed is greater than or equal to a predetermined speed.

The electromagnetic attractive force necessary to open the fuel injector 10 decreases in accordance with a decrease in supplied pressure. When the supplied pressure is low, the first target value I1 can be sufficiently decreased without executing the pre charge control, and a loss of the energy applied to the first coil 13 can be reduced. When the pre charge control is executed, since an energization time period of one time injection is increased during a time period from the time point t0 to the time point t10, a limit of an interval of the multi-injection cannot be shortened.

According to the present embodiment, since the pre charge control is permitted in the condition that the supplied pressure is greater than or equal to the predetermined pressure, the pre charge control is not executed in a case where the supplied pressure is low. Therefore, the limit of the interval of the multi-injection can be shortened.

Third Embodiment

The Ti-q property line becomes different according to the supplied pressure. Specifically, since a force necessary to open the valve body 12 decreases in accordance with the decrease in supplied pressure, the energization time period Ti that is necessary to reach the boundary point between the seat throttle area B1 and the injection-port throttle area B2 decreases in accordance with the decrease in supplied pressure. In other words, the threshold Tth decreases in accordance with the decrease in supplied pressure.

According to a third embodiment, since the threshold Tth decreases in accordance with the decrease in supplied pressure, the first target value I1 is set lower when the supplied pressure is lower. Therefore, the initial-current applied time period Ta is shortened. Further, a reliability for executing the increase control according to the supplied pressure to meet the condition that the initial-current applied time period Ta is less than the threshold Tth.

The initial-current applied time period Ta can be shortened by increasing an increasing slope of the coil current in the increase control, a circuit in which the increasing slope is changeable is necessary. A circuit configuration becomes complicated. According to the present embodiment, since the initial-current applied time period Ta can be shortened by only setting the first target value I1 to be lower, the circuit configuration can be simplified.

The electromagnetic attractive force necessary to open the fuel injector 10 decreases in accordance with the decrease in supplied pressure. Therefore, when the second target value I2 is not decreased, a valve-opening time point becomes faster, and the slope of the Ti-q property line is increased in the seat throttle area B1. Further, a variation of the Ti-q property line generated due to disturbance such as temperature becomes larger, and the accuracy of an injection-amount control is deteriorated in the seat throttle area B1.

According to the present embodiment, since the second target value I2 is set lower when the supplied pressure is lower, it is prevented from increasing the slope of the Ti-q property line in the seat throttle area B1. Therefore, the accuracy of an injection-amount control can be improved in the seat throttle area B1.

Fourth Embodiment

Figure 11:
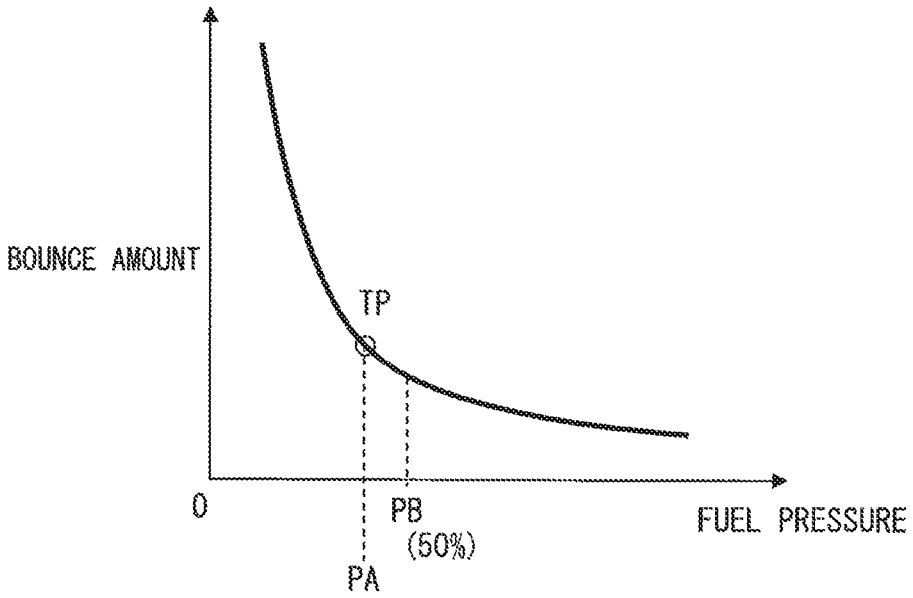
FIG. 11 is a graph showing a relationship between a bounce amount and the fuel pressure, according to a fourth embodiment of the present disclosure.

FIG. 11 shows a pressure-bounce property curved line representing a relationship between a bounce amount and the supplied pressure. In this case, the bounce amount corresponds to the stroke variation amount generated by the bounce of the movable core 15. As shown in FIG. 11, the bounce amount decreases in accordance with an increase in supplied pressure. A point TP is a point that a second derivative value of the pressure-bounce property curved line is the maximum. That is, the variation of the slope of the pressure-bounce property curved line is maximum at the point TP.

According to the present embodiment, the increase control is executed by the increase control portion 21*a* at a fuel pressure greater than the point TP. For example, the increase control is prohibited in a case where the fuel pressure Pc is less than a pressure of the point TP. As shown in FIG. 11, the pressure of the point TP corresponds to the pressure PA. When the increase control is executed, an adjusting valve of the fuel pump P is controlled such that the fuel pressure Pc is greater than or equal to the pressure PA.

A limit of the supplied pressure that is able to open the valve body 12 is referred to as an injection limit pressure. The increase control can be executed in a case where the fuel pressure, for example, the pressure PB shown in FIG. 11, is greater than or equal to 50% of the injection limit pressure.

According to the present embodiment, since the increase control is executed at the pressure greater than or equal to the point TP, the bounce amount can be remarkably reduced. Further, the pulse generated relative to the Ti-q property line can be reduced, and the accuracy of the injection-amount control can be improved.

Fifth Embodiment

Figure 12:
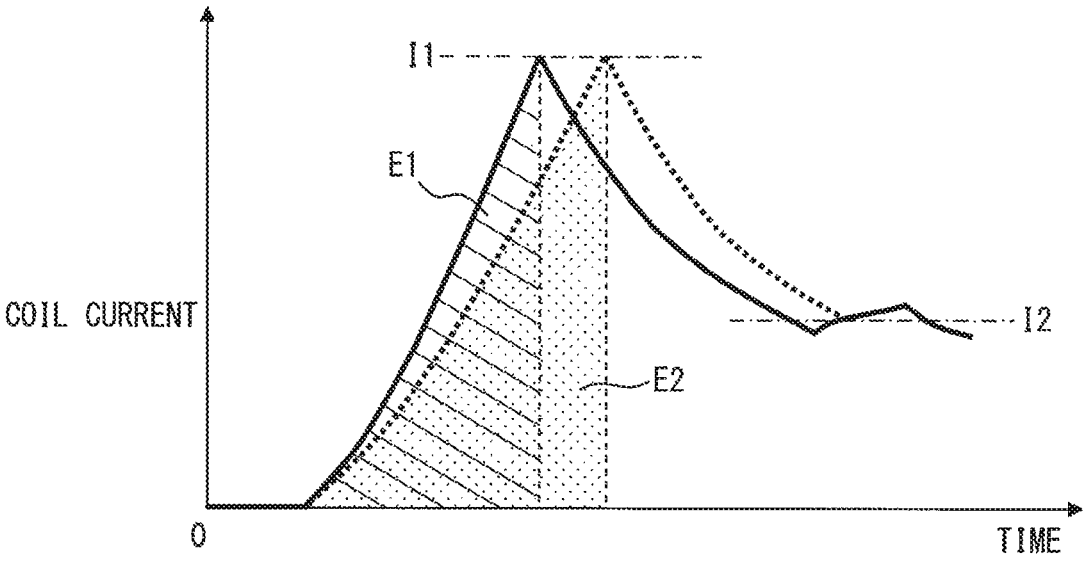
FIG. 12 is a graph showing an initial energy applied amount, according to a fifth embodiment of the present disclosure.

FIG. 12 is an enlarged view of FIG. 4B and shows a waveform of the coil current in the increase control. The waveform of the coil current varies according to the coil temperature. In FIG. 12, a solid line represents the waveform of when the coil temperature is the normal temperature, and a dotted line represents the waveform of when the coil temperature is the high temperature. Further, an area E1 with oblique lines and an area E2 with dots are integrated values of the coil currents applied to the first coil 13 to increase the coil current to the first target value I1. The integrated values E1, E2 are referred to as initial energy applied amounts E1, E2. The initial energy applied amount varies according to the coil temperature. The increase control portion 21*a* controls the coil current such that differential amounts of the initial energy applied amounts E1, E2 generated due to the variation in the coil temperature are less than a predetermined value. For example, the predetermined value is set to 10%.

Specifically, the increase control is executed such that a condition that the differential amount of the initial energy applied amount is less than 10% is met, even though the waveform of the coil current varies in a coil-temperature width. In this case, the coil-temperature width corresponds to an operating condition of the fuel injector 10, such as from −30 degrees centigrade to 160 degrees centigrade. In addition, when the internal combustion engine is started such that the first coil 13 is energized for the first time to inject fuel for the first time, the increase control is not limited to the above condition. Alternatively, when the internal combustion engine is started such that the fuel injection amount is increased, the increase control is not limited to the above condition.

Figure 13:
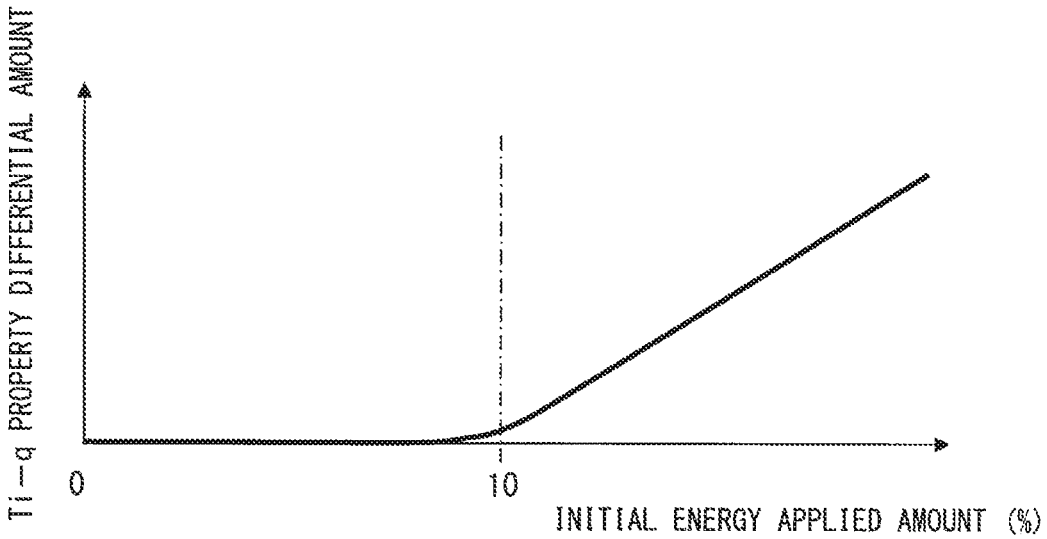
FIG. 13 is a graph showing a relationship between an initial energy applied differential amount and a Ti-q property differential amount, according to the fifth embodiment.

FIG. 13 is a graph showing a relationship between an initial energy applied differential amount and the Ti-q property differential amount. As shown in FIG. 13, when the initial energy applied differential amount decreases to a boundary value 10%, the Ti-q property differential amount sharply decreases. According to the present embodiment, since the increase control is executed such that the initial energy applied differential amount is less than 10%, the temperature property variation is remarkably restricted, and the robustness of the control is improved relative to the variation in the coil temperature.

Sixth Embodiment

Figure 14:
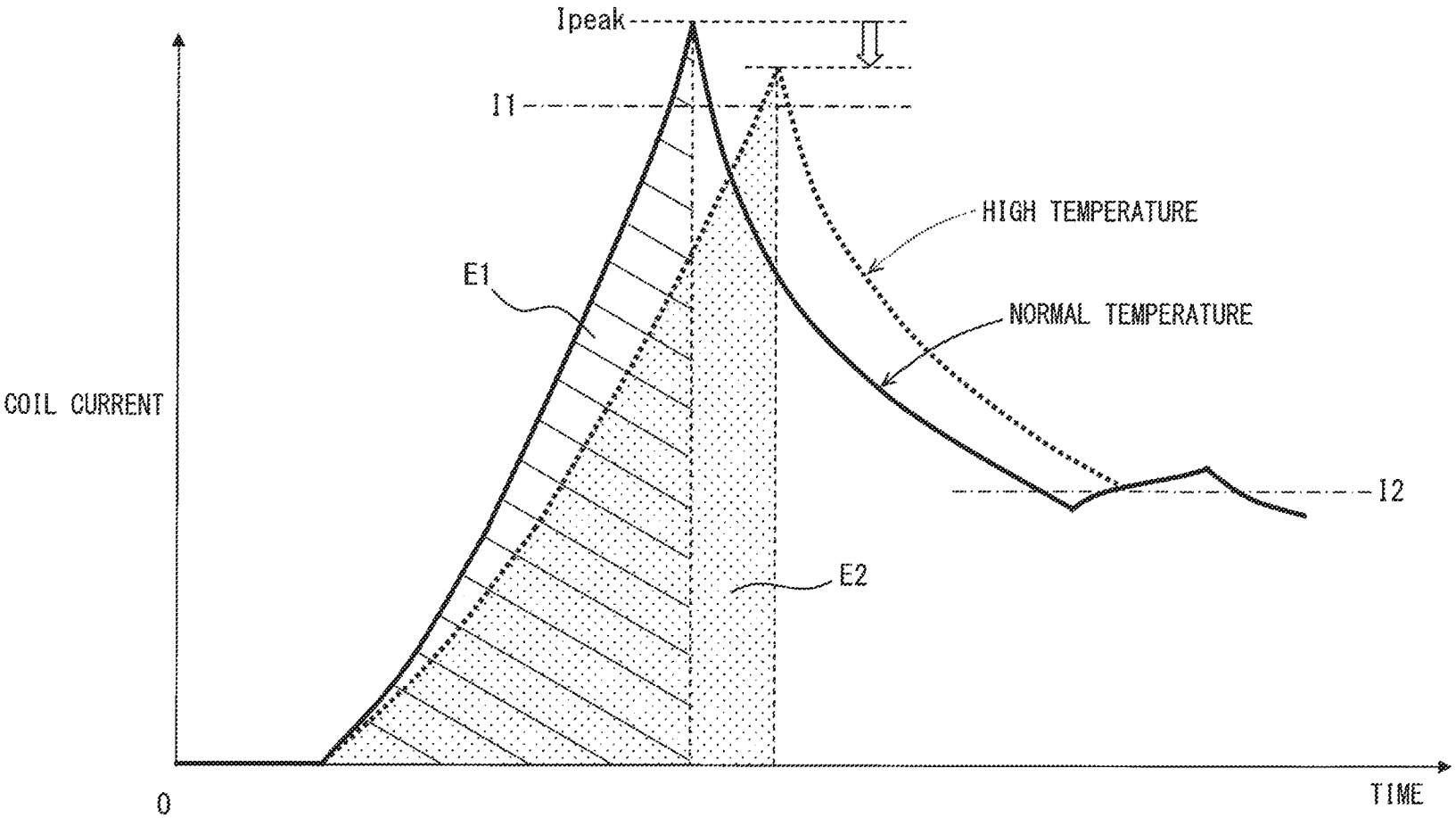
FIG. 14 is a graph showing a relationship between the initial energy applied differential amount and the Ti-q property differential amount, according to a sixth embodiment of the present disclosure.

According to the first embodiment, the boost voltage applied to the first coil 13 is terminated at the time point that the coil current reaches the first target value I1. Therefore, as shown in FIGS. 4B and 12, the coil current starts to decrease at the time point that the coil current reaches the first target value I1. However, considering a responsivity of the coil current, as shown in FIG. 14, the coil current increases to overshoot the first target value I1. When the waveform of the coil current becomes different due to the coil temperature, a peak value Ipeak of the coil current becomes different. For example, in FIG. 14, the peak value of a solid line is different from the peak value of a dotted line.

According to the present embodiment, since the resistance of the first coil 13 increases in accordance with an increase in coil temperature, the coil current is controlled such that the peak value Ipeak decreases in accordance with an increase in resistance of the first coil 13. Specifically, the first switching element SW1 uses a field effective transistor (FET) having a discharge capacity greater than or equal to a predetermined capacity. For example, the first switching element SW1 may use a metal-oxide-semiconductor field-effect transistor (MOSFET).

An overshoot amount increases in accordance with an increase in increasing rate of the coil current. Therefore, the peak value Ipeak increases. When the resistance of the first coil 13 becomes greater according to the coil temperature, the peak value Ipeak becomes smaller. When the discharge capacity of the MOSFET is sufficiently large, a variation of the peak value Ipeak is excessively small and can be omitted. In this case, it can be determined that the peak value Ipeak is not changed. According to the present embodiment, since the MOSFET having a sufficiently large discharge capacity is used, the peak value Ipeak decreases in accordance with an increase in coil temperature.

When the increasing rate of the coil current is decreased due to the high temperature, a time period for the coil current to reach the first target value I1 becomes longer. Further, when the peak value Ipeak is high, the initial energy applied amount is increased. According to the present embodiment, since the MOSFET having a sufficiently large discharge capacity is used, the peak value Ipeak decreases in accordance with an increase in coil temperature. As the above description according to the present embodiment, the initial energy applied differential amount can be readily decreased. In other words, the MOSFET is used such that the initial energy applied differential amount is less than the predetermined value.

Seventh Embodiment

Figure 15:
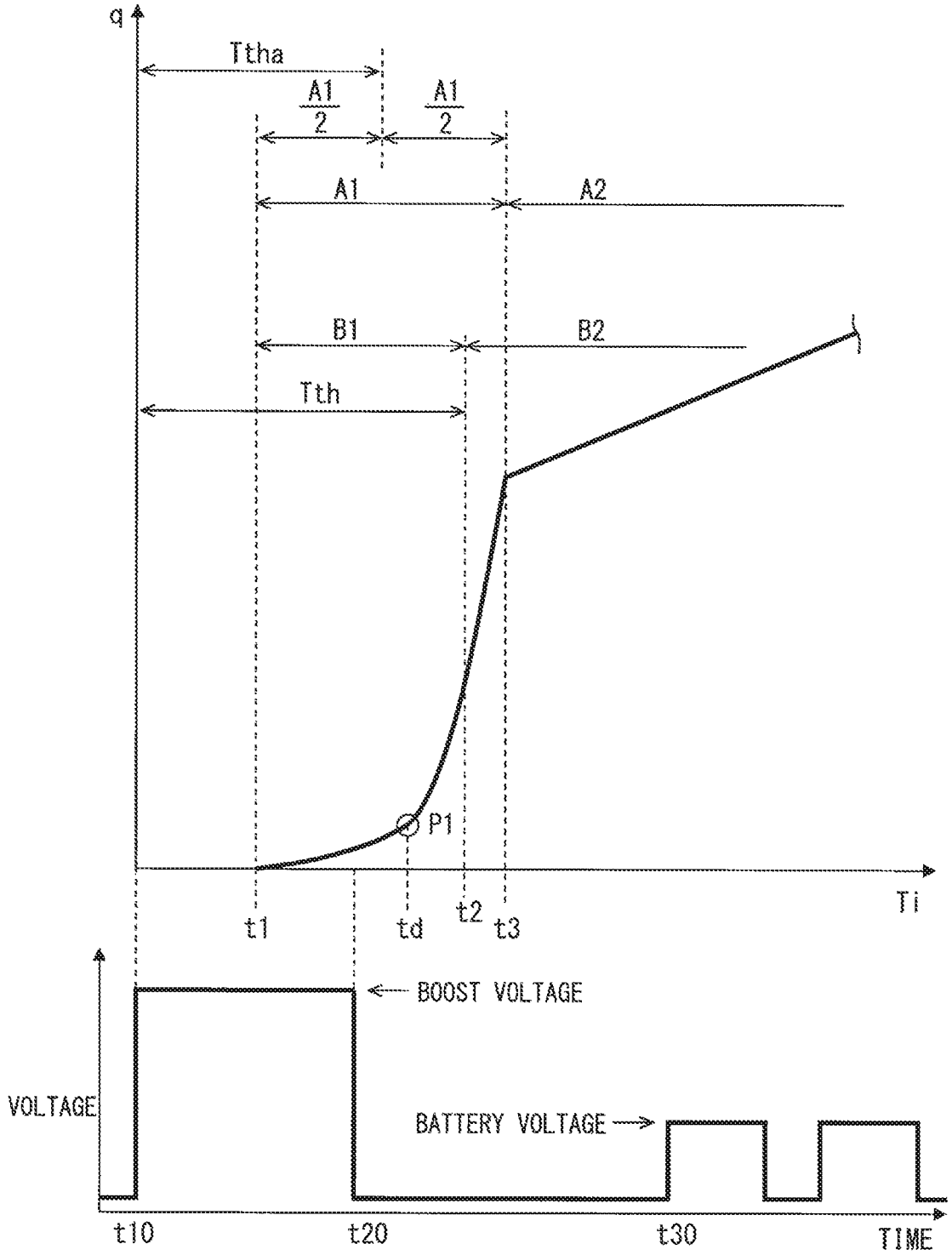
FIG. 15 is a graph showing a relationship between a time point that a boost energization is completed and the injection amount, according to a seventh embodiment of the present disclosure.
Figure 16A:
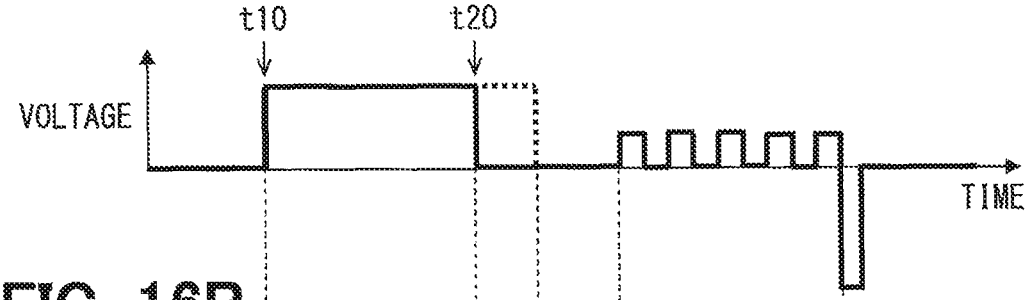
FIG. 16A is a graph showing a relationship between a voltage applied to a coil and time.
Figure 16B:
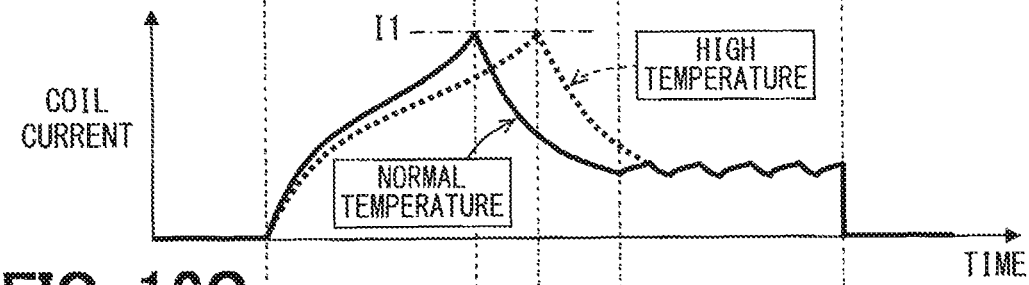
FIG. 16B is a graph showing a relationship between a coil current and time.
Figure 16C:
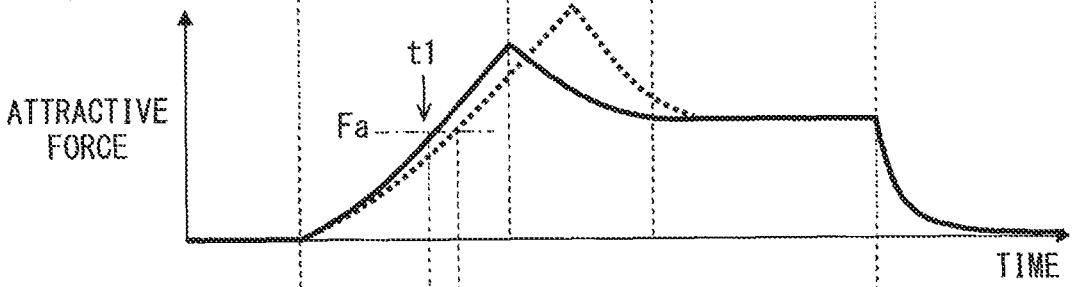
FIG. 16C is a graph showing a relationship between an electromagnetic attractive force and time.
Figure 16D:
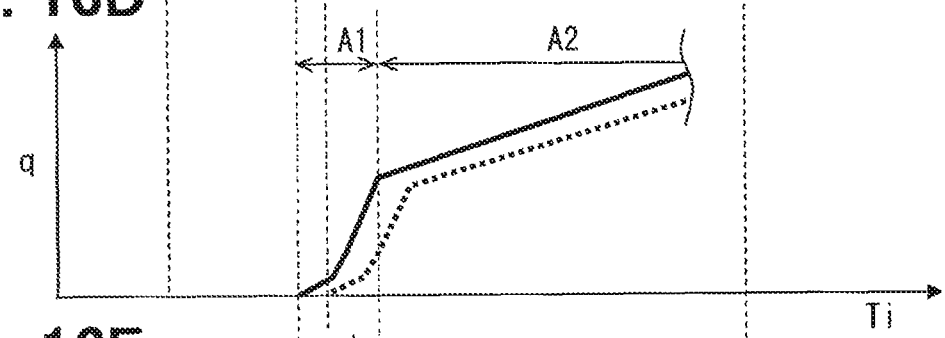
FIG. 16D is a graph showing a relationship between an injection amount and time.
Figure 16E:
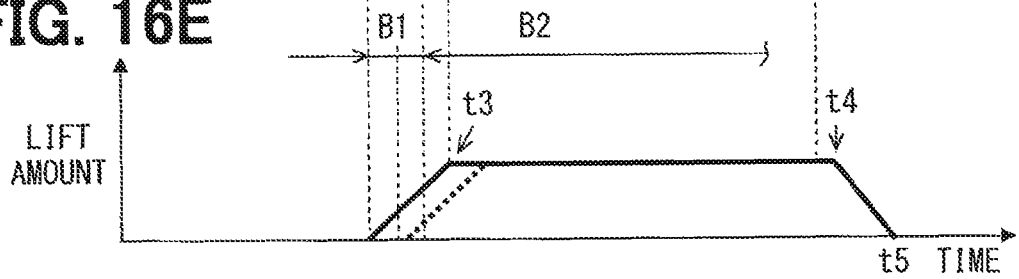
FIG. 16E is a graph showing a relationship between a lift amount and time, when an injection control is executed according to a conventional example.

According to the first embodiment, the coil current is controlled such that the initial-current applied time period Ta is less than the threshold Tth, and the threshold Tth corresponds to the energization time period Ti that is necessary to reach the boundary point between the seat throttle area B1 and the injection-port throttle area B2 from the time point t10. In other words, the boost voltage applied to the first coil 13 is terminated at the time point that the seat throttle ratio reaches 50%. According to the present embodiment, in FIG. 15, the boost voltage is supplied to the first coil 13 before a time point td that the injection amount q reaches a turning point P1. In other words, the time point t20 is ahead of the time point td. FIG. 15 corresponds to FIGS. 4D and 4A to show the injection amount q and the waveform of the voltage applied to the first coil 13.

When the seating surface 12*a* separates from the seated surface 17*b* right after the time point t1, since a flow-throttling degree of the seating surface 12*a* is large, a fuel-pressure valve-opening force corresponding to the fuel pressure applied to the seating surface 12*a* and other parts downstream of the valve body 12 is small. Therefore, a lift-up rate of the valve body 12 is slow, and the slope of the Ti-q property line is small. However, even in the partial area A1, since the flow-throttling degree decreases in accordance with an increase in lift amount, the fuel-pressure valve-opening force becomes greater. Therefore, the lift-up rate becomes faster, and the slope of the Ti-q property line becomes greater.

In a first period of the partial area A1, the slope of the Ti-q property line is small because a seat-throttling degree is large. In a second period of the partial area A1, the slope of the Ti-q property line becomes greater because the seat-throttling degree becomes smaller. Thus, the slope of the Ti-q property line increases in accordance with the increase in lift amount.

In addition, the slope of the Ti-q property line exponentially increases in accordance with the increase in lift amount. Further, the turning point P1 is a point that an increasing rate of the slope is the maximum. Specifically, at the turning point P1, a second derivative value of the Ti-q property line is the maximum, and the increasing rate of the slope is the maximum. Therefore, the injection amount q increases sharply from the turning point P1.

When the coil current is sharply increased to increase the electromagnetic attractive force while the gap between the stator core 14 and the movable core 15 is large, the variation of the electromagnetic attractive force due to the coil temperature becomes smaller. Therefore, the temperature property variation decreases in accordance with a decrease in initial-current applied time period Ta.

According to the present embodiment, the increase control portion 21*a* controls the coil current such that a boost energization stop time point t20 that the boost voltage applied to the first coil 13 is terminated is ahead of the time point td that the injection amount q reaches the turning point P1. In other words, the boost voltage is terminated before the injection amount q reaches the turning point P1. When the coil current is sharply increased to increase the electromagnetic attractive force while the gap between the stator core 14 and the movable core 15 is large, the variation of the electromagnetic attractive force due to the coil temperature may become smaller. Therefore, the temperature property variation can be decreased in accordance with a decrease in initial-current applied time period Ta.

Eighth Embodiment

According to the first embodiment, the energization time period Ti that is necessary to reach the boundary point between the seat throttle area B1 and the injection-port throttle area B2 from the time point t10 is set as the threshold Tth, and the coil current is controlled such that the initial-current applied time period Ta is less than the threshold Tth. According to the present embodiment, as shown in FIGS. 4, 10, and 15, the energization time period Ti that is necessary for a position of the valve body 12 to reach 50% of the maximum valve-opening position is set as a threshold Ttha, and the coil current is controlled such that the initial-current applied time period Ta is less than the threshold Ttha.

When the initial-current applied time period Ta is less than the threshold Tth, the temperature property variation can be restricted. Further, the threshold Ttha set according to the lift amount is substantially equal to the threshold Tth set according to the boundary point between the seat throttle area B1 and the injection-port throttle area B2.

Thus, the present embodiment can achieve the same effects as the first embodiment. That is, when the coil current is sharply increased to increase the electromagnetic attractive force while the gap between the stator core 14 and the movable core 15 is large, the variation of the electromagnetic attractive force due to the coil temperature becomes smaller.

Other Embodiment

The present disclosure is not limited to the above embodiments, and may change as followings. Further, various combinations of the features of the above embodiments are also within the spirit and scope of the present disclosure.

(a) According to the present disclosure, it is not limited to the fuel injector having the Ti-q property line as shown in FIG. 4D. For example, a fuel injector in which the slope of the Ti-q property line in the seat throttle area B1 is less than that in the injection-port throttle area B2 may be used. Alternatively, a fuel injector in which the slope of the Ti-q property line is constant may be used.

(b) According to the first embodiment, in FIGS. 4D and 4E, the boundary point between the seat throttle area B1 and the injection-port throttle area B2 is ahead of a full-lift time point that the valve body 12 reaches the full-lift position. The present disclosure is not limited to above. For example, a fuel injector in which the boundary point matches with the full-lift time point may be used.

(c) As shown in FIGS. 4A to 4E, the increase control and the constant current control are executed such that the initial-current applied time period Ta is less than a half of the constant current control time period. The present disclosure is not limited to the above.

(d) As shown in FIGS. 4A to 4E, the first target value I1 is greater than or equal to twice of the second target value I2. The present disclosure is not limited to the above.

(c) As shown in FIG. 2, in the fuel injector 10, the valve body 12 is assembled to be slidable with respect to the movable core 15, and an elastic force applying portion includes two springs SP1 and SP2. However, for example, the valve body 12 may be provided to fix to the movable core 15. Alternatively, the elastic force applying portion only includes the main spring SP1. Further, the sub spring SP2 may be canceled.

(d) According to the first embodiment, when the coil current is increased to the first target value I1 by the increase control, the coil current is decreased to the second target value I2. However, the coil current may be held to the first target value I1 after the coil current is increased to the first target value I1 by the increase control, and then may be decreased to the third target value I3. In other words, the second target value I2 may be set to a value equal to the first target value I1 in the first embodiment.

(e) According to the above embodiments, the entire of the magnetic circuit portion 16*b* is surrounded over the whole periphery by the first inner peripheral surface 4*a* of the attachment hole 4. However, according to the present disclosure, a part of the magnetic circuit portion 16*b* may be surrounded over the whole periphery by the first inner peripheral surface 4*a* of the attachment hole 4. Alternatively, the entire of the coil portion 16*a* may be surrounded over the whole periphery by the first inner peripheral surface 4*a* of the attachment hole 4 in the inserting direction. Alternatively, a part of the coil portion 16*a* may be surrounded over the whole periphery by the first inner peripheral surface 4*a* of the attachment hole 4 in the inserting direction.

(f) As shown in FIG. 1, the fuel injector 10 is provided in the cylinder head 3. However, according to the present disclosure, the fuel injector 10 may be provided in a cylinder block. Further, according to the embodiments, the fuel injector 10 mounted to the internal combustion engine of the ignition type is used as a controlled subject. However, a fuel injector mounted to an internal combustion engine of a compression self-ignition type such as a diesel engine may be used as the controlled subject. Furthermore, the fuel injector 10 directly injecting fuel into the combustion chamber 10*a* is used as the controlled subject. However, a fuel injector injecting fuel into an intake pipe may be used as the controlled subject.

(g) According to the first embodiment, the adjacent member uses a sintered material made of a metal such that the electrical resistivity of the adjacent member is greater than that of the non-adjacent member. However, at least a part of the adjacent member or at least a part of the non-adjacent member may be mixed with the sintered material.

(h) According to the third embodiment, the first target value I1 and the second target value I2 are changed according to the supplied pressure. However, the first target value I1 or the second target value I2 may be previously determined without respect to the supplied pressure.

(i) According to the above embodiments, when the coil current reaches the first target value I1, the first coil 13 is deenergized, and the coil current is decreased. However, the coil current may be held to the first target value I1 for a predetermined time period after the coil current reaches the first target value I1, and then the coil current is decreased.

(j) According to the above embodiments, the constant current control is executed by using the battery voltage. However, the constant current control may be executed by using the boost voltage.

(k) According to the fifth embodiment, the increase control is executed such that the initial energy applied differential amounts E1, E2 are less than the predetermined value that is 10%. However, the predetermined value may be set to 5%, 2%, or 1%.

(l) According to the second embodiment, the third embodiment, the fourth embodiment, the fifth embodiment, and the sixth embodiment, the condition that the initial-current applied time period Ta is less than the threshold Tth is used. However, these embodiments may use a condition that the time point t20 is ahead of the time point td, or a condition that the initial-current applied time period Ta is less than the threshold Ttha.

While the present disclosure has been described with reference to the embodiments thereof, it is to be understood that the disclosure is not limited to the embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A fuel injection controller for a fuel injector including a movable core moved by an electromagnetic force generated by an energization of a coil, a valve body connected with the movable core, a seated surface where the valve body abuts on or separates from, and an injection port exposed to the seated surface, the fuel injector directly injecting a fuel used in a combustion of an internal combustion engine from the injection port into a combustion chamber of the internal combustion engine by moving the valve body to separate from the seated surface together with the movable core that is moved by the electromagnetic force, the fuel injection controller controlling an injection state of the fuel injector by controlling a coil current flowing through the coil, the fuel injection controller comprising:

a boost circuit boosting a battery voltage to a boost voltage; and an increase control portion controlling the boost voltage to be applied to the coil, so as to increase the coil current to be equal to or greater than a first target value, wherein a magnetic circuit through which a magnetic flux generated according to an energization of the coil flows has a part including a sintered material that is made of a metal, and the valve body starts a valve-opening operation in a time period from a time point that the increase control portion starts to apply the boost voltage to the coil to a time point that the coil current is increased to the first target value.

2. A fuel injection controller according to claim 1, wherein the fuel injector has a stator core generating a part of a magnetic circuit as a passage of a magnetic flux generated according to an energization of the coil wherein the stator core generates an electromagnetic force, a movable core being slidable with respect to the valve body wherein the movable core is moved together with the valve body by the electromagnetic force, a main spring applying an elastic force to the valve body in a valve-closing direction, and a sub spring applying an elastic force to the valve body in a valve-opening direction via the movable core.

3. A fuel injection control according to claim 2, wherein a pressure-bounce property curved line represents a relationship between a bounce amount of the movable core relative to the stator core and a pressure of the fuel supplied to the fuel injector, and the increase control is executed by the increase control portion at a pressure greater than a pressure where a second derivative value of the pressure-bounce property curved line is the maximum.

4. A fuel injection controller according to claim 2, wherein a limit of a pressure of the fuel supplied to the fuel injector which is able to open the valve body is referred to as an injection limit pressure, and the increase control is executed by the increase control portion when the pressure of the fuel supplied to the fuel injector is greater than or equal to 50% of the injection limit pressure.

5. A fuel injection controller according to claim 1, wherein the fuel injector is inserted into an attachment hole disposed at a predetermined position of the internal combustion engine, and has a housing receiving the coil, the housing is cylinder-shaped and generates a part of a magnetic circuit through which a magnetic flux generated according to an energization of the coil flows, the housing has a coil portion accommodating the coil, the attachment hole has an inner peripheral surface, and an outer peripheral surface of at least a part of the coil portion is surrounded by the inner peripheral surface over the whole periphery.

6. A fuel injection controller according to claim 1 being applied to a combustion system having a fuel pump, the fuel pump driven by the internal combustion engine and generating a pressure of the fuel supplied to the fuel injector, wherein the increase control is executed by the increase control portion, when the internal combustion engine is operating in an idle operation.

7. A fuel injection controller according to claim 1, wherein the increase control is executed by the increase control portion, when a multi-injection in which fuel is divided to be injected for multiple times in a single combustion cycle is executed.

8. A fuel injection controller according to claim 1, further comprising a constant current control portion controlling a voltage to be applied to the coil, so as to reduce the coil current that is increased by the increase control portion and to hold the coil current applied to the coil at a second target value, wherein the constant current control portion controls the battery voltage to be applied to the coil so as to hold the coil current applied to the coil at the second target value.

9. A fuel injection controller according to claim 1, wherein an integrated value of the coil current flowing according to the increase control portion is referred to as an initial energy applied amount, and the increase control portion executes the increase control to control the coil current such that a differential amount of the initial energy applied amount generated due to a variation in a coil temperature is less than a predetermined value.

10. A fuel injection controller according to claim 9, wherein the increase control portion executes the increase control to control the coil current such that a peak value of the coil current flowing according to the increase control portion decreases in accordance with the coil temperature.

11. A fuel injection controller according to claim 9, wherein the boost circuit has a condenser and a switching member, and the boost circuit boosts the voltage by switching the switching member to charge or discharge the condenser, and p1 the switching member has a discharge capacity greater than a predetermined capacity.

12. A fuel injection system comprising:

the fuel injection controller according to claim 1; and the fuel injector.

13. A fuel injection controller according to claim 1, wherein the boost voltage is applied to the coil by turning on a second switching element and a fourth element, and the valve body starts the valve-opening operation in a time period where the second switching element is turned on.

* * * * *